US006482582B2

(12) United States Patent
Watanabe et al.

(10) Patent No.: US 6,482,582 B2
(45) Date of Patent: Nov. 19, 2002

(54) IMAGE RECORDING MATERIAL

(75) Inventors: Katsuyuki Watanabe, Minami-ashigara (JP); Masaru Takasaki, Minami-ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/910,924

(22) Filed: Jul. 24, 2001

(65) Prior Publication Data

US 2002/0048716 A1 Apr. 25, 2002

(30) Foreign Application Priority Data

Jul. 24, 2000 (JP) ..... 2000-221686

(51) Int. Cl.[7] ..... G03C 1/498; G03C 1/34; G03C 1/42

(52) U.S. Cl. ..... 430/566; 430/224; 430/264; 430/543; 430/607; 430/617; 430/619; 430/620; 430/955; 430/957; 430/959

(58) Field of Search ..... 430/566, 957, 430/543, 955, 959, 960, 224, 620, 264, 607, 617, 619

(56) References Cited

U.S. PATENT DOCUMENTS 4,049,455 A * 9/1977 Kikuchi et al.
4,063,950 A * 12/1977 Fujiwhara et al.
4,075,021 A * 2/1978 Kikuchi et al.
4,213,784 A 7/1980 Ikenoue et al.
5,026,633 A 6/1991 Weigel
5,545,515 A 8/1996 Murray et al.

* cited by examiner

*Primary Examiner*—Thori Chea
(74) *Attorney, Agent, or Firm*—Birch, Stewart, Kolasch & Birch, LLP

(57) ABSTRACT

Disclosed in an image recording material comprising, on a support, a photosensitive silver halide, a reducing agent, a binder and a compound represented by the following Formula (1):

wherein, in Formula (1), $R^1$ and $R^2$ each independently represent a substituent, $R^1$ and $R^2$ may be bonded to each other to form a ring, X represents a halogen atom, L represents a methylene group, m represents an integer of 0–7, Y represents a divalent bridging group, n represents 0 or 1 and Z represents a residue derived from a photographically useful compound. This image recording material exhibits high sensitivity, low fog and good storage stability, and is stable against fluctuation of development conditions.

21 Claims, 1 Drawing Sheet

IMAGE RECORDING MATERIAL

FIELD OF THE INVENTION

The present invention relates to an image recording material. More precisely, the present invention relates to an image recording material that exhibits high sensitivity, low fog and good storage stability, and is stable against fluctuation of development conditions.

BACKGROUND OF THE INVENTION

A large number of photosensitive materials are known which have a photosensitive layer on a support and form images by exposing them imagewise. They include those utilizing a technique of forming an image by heat development as a system that contributes environmental conservation or simplification of image formation.

In recent years, reduction of amount of waste processing solutions is strongly desired in the field of photomechanical process from the standpoints of environmental protection and space savings. Techniques relating to photothermographic materials for use in photomechanical process are required, which enables efficient exposure by a laser scanner or laser image setter and formation of a clear black image having high resolution and sharpness. Such photothermographic materials can provide users with a simpler and non-polluting heat development processing system that eliminates the use of solution-type processing chemicals.

Methods for forming images by heat development are described in, for example, U.S. Pat. Nos. 3,152,904 and 3,457,075 and D. Klosterboer, "Thermally Processed Silver Systems A", Imaging Processes and Materials, Neblette, 8th ed., compiled by J. Sturge, V. Walworth and A. Shepp, Chapter 9, p. 279, (1989). The photothermographic materials contain a reducible non-photosensitive silver source (e.g., silver salt of organic acid), a photocatalyst (e.g., silver halide) in a catalytically active amount, and a reducing agent for silver, which are usually dispersed in an organic binder matrix. These photothermographic materials are stable at an ambient temperature, but when the materials are heated at a high temperature (e.g., 80° C. or higher) after light exposure, silver is produced through an oxidation-reduction reaction between the reducible silver source (which functions as an oxidizing agent) and the reducing agent. The oxidation-reduction reaction is accelerated by catalytic action of a latent image generated upon exposure. The silver produced by the reaction of the reducible silver salt in the exposed region provides a black color and this presents a contrast to the non-exposure region to form an image.

U.S. Pat. Nos. 5,496,695, 5,545,515, 5,654,130, 5,705,324 and so forth disclose photothermographic materials providing ultrahigh contrast images that contains an ultrahigh contrast agent. However, in these photothermographic materials, high Dmin due to thermal fog, fluctuation of sensitivity and size of half tone dots depending on change of development conditions and so forth pose serious problems.

For photothermographic materials, increase of sensitivity of the materials is required in view of reduction of costs for development apparatuses, light source used for light exposure such as lasers and so forth. Development enhancers are disclosed in U.S. Pat. Nos. 5,026,633, 5,545,505, 5,545,507, 5,558,983, 5,637,449 and so forth. However, these development enhancers may suffer from disadvantages, for example, their effect may not be sufficient, they may show strong thermal fog upon development, they may show bad storability of images after development and so forth.

Fog is a serious problem in photographic materials. Various researches have been made to reduce the fog in photothermographic materials. For example, U.S. Pat. No. 3,589,903 discloses use of mercury salts. Furthermore, there have also been disclosed uses of carboxylic acids such as benzoic acid and phthalic acid (U.S. Pat. No. 4,152,160), benzoylbenzoic acid compounds (U.S. Pat. No. 4,784,939), indane or tetralincarboxylic acids (U.S. Pat. No. 4,569,906), dicarboxylic acids (U.S. Pat. No. 4,820,617), heteroaromatic carboxylic acids (U.S. Pat. No. 4,626,500), halogenated compounds (U.S. Pat. Nos. 4,546,075, 4,756,999, 4,452,885, 3,874,946 and 3,955,982), halogen molecules or halogen atoms bonded to heterocycles (U.S. Pat. No. 5,028,523), palladium compounds (U.S. Pat. No. 4,103,312 and British Patent No. 1,502,670), iron family compounds (U.S. Pat. No. 4,128,428), substituted triazoles (U.S. Pat. Nos. 4,123,374, 4,129,557 and 4,125,430), sulfur compounds (U.S. Pat. Nos. 4,213,784, 4,245,033, and Japanese Patent Laid-open Publication (Kokai, hereinafter referred to as JP-A) 51-26019), thiouracils (U.S. Pat. No. 4,002,479), sulfinic acid (JP-A-50-123331), metal salts of thiosulfonic acid (U.S. Pat. Nos. 4,125,403, 4,152,160 and 4,307,187) and combinations of metal salts of thiosulfonic acid and sulfinic acid (JP-A-53-20923 and JP-A-53-19825), thiosulfonic acid esters (Japanese Patent Publication (Kokoku, hereinafter referred to as JP-B) 62-50810, JP-A-7-209797 and JP-A-9-43760).

Further, disulfide compounds are disclosed in JP-A-51-42529 and JP-B-63-37368, and polyhalogenated compounds are disclosed in JP-B-54-165. However, those compounds have drawbacks, for example, insufficient anti-fog effect, insufficient storage stability of photosensitive materials before development, insufficient image storage stability after development (for example, coloration of non-image areas caused by heat or light), and decrease of sensitivity and Dmax when those compounds are added in an amount for sufficiently suppress the fog.

SUMMARY OF THE INVENTION

An object of the present invention is to solve the aforementioned problems of the prior art. That is, the object of to be achieved by the present invention is to provide an image recording material that exhibits high sensitivity, low fog and good storage stability, and is stable against fluctuation of development conditions.

The inventors of the present invention assiduously studied in order to achieve the aforementioned object. As a result, they found that an excellent image recording material that provides the desired effects could be obtained by using a compound represented by the following Formula (1) in an image forming material, and thus accomplished the present invention.

That is, the present invention provides an image recording material comprising, on a support, a photosensitive silver halide, a reducing agent, a binder and a compound represented by the following Formula (1):

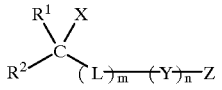

wherein, in Formula (1), $R^1$ and $R^2$ each independently represent a substituent, $R^1$ and $R^2$ may be bonded to each other to form a ring, X represents a halogen atom, L represents a methylene group, m represents an integer of 0–7, Y represents a divalent bridging group, n represents 0 or 1 and Z represents a residue derived from a photographically useful compound.

Preferably, the image record material of the present invention further contains a reducible silver salt.

Preferably, the image record material of the present invention further contains an ultrahigh contrast agent.

Preferably, the image record material of the present invention is a thermally processed image recording material.

According to the present invention, it became possible to provide an image recording material that exhibits high sensitivity, low fog and good storage stability, and is stable against fluctuation of development conditions.

PREFERRED EMBODIMENTS OF THE INVENTION

Figure 1:
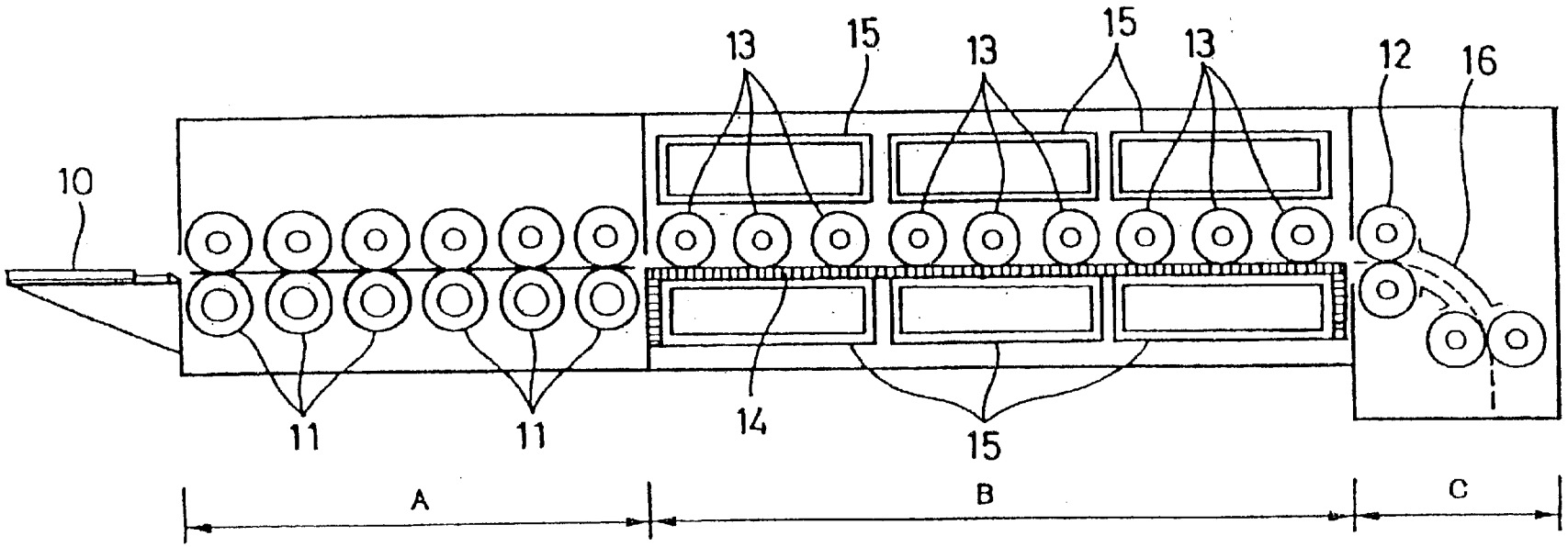
FIG. 1 is a side view of an exemplary heat development apparatus used for heat development of the image recording material of the present invention. In the FIGURE, there are shown a thermally processed image recording material 10, carrying-in roller pairs 11, carrying-out roller pairs 12, rollers 13, a flat surface 14, heaters 15, and guide panels 16. The apparatus consists of a preheating section A, a heat development section B, and a gradual cooling section C.

Hereafter, embodiments and methods for practicing the present invention of the present invention will be explained in detail. In the present specification, ranges indicated with "-" mean ranges including the numerical values before and after "-" as the minimum and maximum values.

The image record material of the present invention is characterized by containing a compound represented by Formula (1).

In Formula (1), $R^1$ and $R^2$ each independently represent a substituent, and they may be any substituents so long as they do not adversely affect photographic performance.

Examples of the substituents represented by $R^1$ and $R^2$ include, for example, an alkyl group (including a cycloalkyl group and a bicycloalkyl group), an alkenyl group (including a cycloalkenyl group and a bicycloalkenyl group), an alkynyl group, an aryl group, a heterocyclic group, a cyano group, a hydroxyl group, a nitro group, a carboxyl group, an alkoxy group, an aryloxy group, a silyloxy group, a heterocyclyloxy group, an acyloxy group, a carbamoyloxy group, an alkoxycarbonyloxy group, an aryloxycarbonyloxy, an amino group (including an anilino group), an acylamino group, an aminocarbonylamino group, an alkoxycarbonylamino group, an aryloxycarbonylamino group, a sulfamoylamino group, an alkyl- or arylsulfonylamino group, a mercapto group, an alkylthio group, an arylthio group, a heterocyclylthio group, a sulfamoyl group, a sulfo group, an alkyl- or arylsulfinyl group, an alkyl- or arylsulfonyl group, an acyl group, an aryloxycarbonyl group, an alkoxycarbonyl group, a carbamoyl group, an aryl- or heterocyclylazo group, an imido group, a phosphino group, a phosphinyl group, a phosphinyloxy group, a phosphinylamino group, a silyl group and so forth.

More specifically, the followings can be mentioned as examples of the substituents:

an alkyl group [a linear, branched or cyclic substituted or unsubstituted alkyl group and an alkyl group consisting of a combination thereof, including an alkyl group (preferably an alkyl group having 1–30 carbon atoms, e.g., methyl, ethyl, n-propyl, isopropyl, t-butyl, n-octyl, eicosyl, 2-chloroethyl, 2-cyanoethyl and 2-ethylhexyl), a cycloalkyl group (preferably a substituted or unsubstituted cycloalkyl group having 3–30 carbon atoms, e.g., cyclohexyl, cyclopentyl and 4-n-dodecylcyclohexyl), a bicycloalkyl group (preferably a substituted or unsubstituted bicycloalkyl group having 5–30 carbon atoms, i.e., a monovalent group obtained by removing one hydrogen atom from a bicycloalkane having 5–30 carbon atoms, e.g., bicyclo[1,2,2]heptan-2-yl and bicyclo[2,2,2]octan-3-yl), and an alkyl group having a structure containing more rings such as tricyclic structure and so forth, the alkyl groups in the substituents explained below (for example, alkyl group of alkylthio group) also represent such a conception of alkyl group];

an alkenyl group [a linear, branched or cyclic substituted or unsubstituted alkenyl group, including an alkenyl group (preferably a substituted or unsubstituted alkenyl group having 2–30 carbon atoms, e.g., vinyl, allyl, prenyl, geranyl and oleyl), a cycloalkenyl group (preferably a substituted or unsubstituted cycloalkenyl group having 3–30 carbon atoms, i.e., a monovalent group obtained by removing one hydrogen atom from a cycloalkene having 3–30 carbon atoms, e.g., 2-cyclopenten-1-yl and 2-cyclohexen-1-yl), and a bicycloalkenyl group (a substituted or unsubstituted bicycloalkenyl group, preferably a substituted or unsubstituted bicycloalkenyl group having 5–30 carbon atoms, i.e., a monovalent group obtained by removing one hydrogen atom from a bicycloalkene having one double bond, e.g., bicyclo[2,2,1]hept-2-en-1-yl and bicyclo[2,2,2]oct-2-en-4-yl)];

an alkynyl group (preferably a substituted or unsubstituted alkynyl group having 2–30 carbon atoms, e.g., ethynyl, propargyl, trimethylsilylethynyl etc.);

an aryl group (preferably a substituted or unsubstituted aryl group having 6–30 carbon atoms, e.g., phenyl, p-tolyl, naphthyl, m-chlorophenyl, o-hexadecanoyl and aminophenyl);

a heterocyclic group (preferably a 5- or 6-membered substituted or unsubstituted monovalent group obtained by removing one hydrogen atom from an aromatic or non-aromatic heterocyclic compound, more preferably 5- or 6-membered aromatic heterocyclic group having 3–30 carbon atoms, e.g., 2-furyl, 2-thienyl, 2-pyrimidinyl and 2-benzothiazolyl;

a cyano group;

a hydroxyl group;

a nitro group;

a carboxyl group;

an alkoxy group (preferably a substituted or unsubstituted alkoxy group having 1–30 carbon atoms, e.g., methoxy, ethoxy, isopropoxy, t-butoxy, n-octyloxy and 2-methoxyethoxy);

an aryloxy group (preferably a substituted or unsubstituted aryloxy group having 6–30 carbon atoms, e.g., phenoxy, 2-methylphenoxy, 4-t-butylphenoxy, 3-nitrophenoxy and 2-tetradecanoylaminophenoxy);

a silyloxy group (preferably a silyloxy group having 3–20 carbon atoms, e.g., trimethylsilyloxy and t-butyldimethylsilyloxy);

a heterocyclyloxy group (preferably a substituted or unsubstituted heterocyclyloxy group having 2–30 carbon atoms, e.g., 1-phenyltetrazol-5-oxy and 2-tetrahydropyranyloxy);

an acyloxy group (preferably a formyloxy group, a substituted or unsubstituted alkylcarbonyloxy group having 2–30 carbon atoms, a substituted or unsubstituted arylcarbonyloxy group having 6–30 carbon atoms, e.g., formyloxy, acetyloxy, pivaloyloxy, stearoyloxy, benzoyloxy and p-methoxyphenylcarbonyloxy);

a carbamoyloxy group (preferably a substituted or unsubstituted carbamoyloxy group having 1–30 carbon atoms, e.g., N,N-dimethylcarbamoyloxy, N,N-diethylcarbamoyloxy, morpholinocarbonyloxy, N,N-di-n-octylaminocarbonyloxy and N-n-octylcarbamoyloxy);

an alkoxycarbonyloxy group (preferably a substituted or substituted alkoxycarbonyloxy group having 2–30 carbon atoms, e.g., methoxycarbonyloxy, ethoxycarbonyloxy, t-butoxycarbonyloxy and n-octylcarbonyloxy);

an aryloxycarbonyloxy group (preferably a substituted or unsubstituted aryloxycarbonyloxy group having 7–30 carbon atoms, e.g., phenoxycarbonyloxy, p-methoxyphenoxy-carbonyloxy and p-n-hexadecyloxyphenoxycarbonyloxy);

an amino group (preferably an amino group, a substituted or unsubstituted alkylamino group having 1–30 carbon atoms, a substituted or unsubstituted anilino group having 6–30 carbon atoms, e.g., amino, methylamino, dimethylamino, anilino, N-methyl-anilino and diphenylamino);

an acylamino group (preferably a formylamino group, a substituted or unsubstituted alkylcarbonylamino group having 1–30 carbon atoms, a substituted or unsubstituted arylcarbonylamino group having 6–30 carbon atoms, e.g., formylamino, acetylamino, pivaloylamino, lauroylamino, benzoylamino and 3,4,5-tri-n-octyloxyphenylcarbonylamino);

an aminocarbonylamino group (preferably a substituted or unsubstituted aminocarbonylamino having 1–30 carbon atoms, e.g., carbamoylamino, N,N-dimethylaminocarbonylamino, N,N-diethylaminocarbonylamino and morpholinocarbonylamino);

an alkoxycarbonylamino group (preferably a substituted or unsubstituted alkoxycarbonylamino group having 2–30 carbon atoms, e.g., methoxycarbonylamino, ethoxycarbonylamino, t-butoxycarbonylamino, n-octadecyl-oxycarbonylamino and N-methyl-methoxycarbonylamino);

an aryloxycarbonylamino group (preferably a substituted or unsubstituted aryloxycarbonylamino group having 7–30 carbon atoms, e.g., phenoxycarbonylamino, p-chlorophenoxycarbonylamino, m-n-octyloxyphenoxycarbonylamino);

a sulfamoylamino group (preferably a substituted or unsubstituted sulfamoylamino group having 0–30 carbon atoms, e.g., sulfamoylamino, N,N-dimethylaminosulfonylamino and N-n-octylaminosulfonylamino);

an alkyl- or arylsulfonylamino group (preferably a substituted or unsubstituted alkylsulfonylamino group having 1–30 carbon atoms or a substituted or unsubstituted arylsulfonylamino group having 6–30 carbon atoms, e.g., methylsulfonylamino, butylsulfonylamino, phenylsulfonylamino, 2,3,5-trichlorophenylsulfonylamino and p-methylphenylsulfonylamino);

a mercapto group;

an alkylthio group (preferably a substituted or unsubstituted alkylthio group having 1–30 carbon atoms, e.g., methylthio, ethylthio and n-hexadecylthio);

an arylthio group (preferably a substituted or unsubstituted arylthio group having 6–30 carbon atoms, e.g., phenylthio, p-chlorophenylthio and m-methoxyphenylthio);

a heterocyclylthio group (preferably a substituted or unsubstituted heterocyclylthio group having 2–30 carbon atoms, e.g., 2-benzothiazolylthio and 1-phenyltetrazol-5-ylthio);

a sulfamoyl group (preferably a substituted or unsubstituted sulfamoyl group having 0–30 carbon atoms, e.g., N-ethylsulfamoyl, N-(3-dodecyloxypropyl)sulfamoyl, N,N-dimethylsulfamoyl, N-acetylsulfamoyl, N-benzoylsulfamoyl and N-(N'-phenylcarbamoyl) sulfamoyl);

a sulfo group;

an alkyl- or arylsulfinyl group (preferably a substituted or unsubstituted alkylsulfinyl group having 1–30 carbon atoms or a substituted or unsubstituted arylsulfinyl group having 6–30 carbon atoms, e.g., methylsulfinyl, ethylsulfinyl, phenylsulfinyl and p-methylphenylsulfinyl);

an alkyl- or arylsulfonyl group (preferably a substituted or unsubstituted alkylsulfonyl group having 1–30 carbon atoms or a substituted or unsubstituted arylsulfonyl group having 6–30 carbon atoms, e.g., methylsulfonyl, ethylsulfonyl, phenylsulfonyl and p-methylphenylsulfonyl);

an acyl group (preferably a formyl group, a substituted or unsubstituted alkylcarbonyl group having 2–30 carbon atoms, a substituted or unsubstituted arylcarbonyl group having 7–30 carbon atoms, a substituted or unsubstituted heterocyclylcarbonyl group having 4–30 carbon atoms, in which the carbonyl group is bonded to a carbon atom in the heterocyclic moiety, e.g., acetyl, pivaloyl, 2-chloroacetyl, stearoyl, benzoyl, p-n-octyloxyphenylcarbonyl, 2-pyridylcarbonyl and 2-furylcarbonyl);

an aryloxycarbonyl group (preferably a substituted or unsubstituted aryloxycarbonyl group having 7–30 carbon atoms, e.g., phenoxycarbonyl, o-chlorophenoxycarbonyl, m-nitrophenoxycarbonyl and p-t-butylphenoxycarbonyl);

an alkoxycarbonyl group (preferably a substituted or unsubstituted alkoxycarbonyl group having 2–30 carbon atoms, e.g., methoxycarbonyl, ethoxycarbonyl, t-butoxycarbonyl and n-octadecyloxycarbonyl);

a carbamoyl group (preferably a substituted or unsubstituted carbamoyl group having 1–30 carbon atoms, e.g., carbamoyl, N-methylcarbamoyl, N,N-dimethylcarbamoyl, N,N-di-n-octylcarbamoyl and N-(methylsulfonyl)carbamoyl);

an aryl- or heterocyclylazo group (preferably a substituted or unsubstituted arylazo group having 6–30 carbon atoms or a substituted or unsubstituted heterocyclylazo group having 3–30 carbon atoms, e.g., phenylazo, p-chlorophenylazo and 5-ethylthio-1,3,4-thiadiazol-2-ylazo);

an imido group (preferably N-succinimido and N-phthalimido);

a phosphino group (preferably a substituted or unsubstituted phosphino group having 2–30 carbon atoms, e.g., dimethylphosphino, diphenylphosphino and methylphenoxyphosphino);

a phosphinyl group (preferably a substituted or unsubstituted phosphinyl group having 2–30 carbon atoms, e.g., phosphinyl, dioctyloxyphosphinyl and diethoxyphosphinyl);

a phosphinyloxy group (preferably a substituted or unsubstituted phosphinyloxy group having 2–30 carbon atoms, e.g., diphenoxyphosphinyloxy and dioctyloxyphosphinyloxy);

a phosphinylamino group (preferably a substituted or unsubstituted phosphinylamino group having 2–30 carbon atoms, e.g., dimethoxyphosphinylamino and dimethylaminophosphinylamino); and a silyl group (preferably a substituted or unsubstituted silyl group having 3–30 carbon atoms, e.g., trimethylsilyl, t-butyldimethylsilyl and phenyldimethylsilyl).

As for functional groups having a hydrogen atom among the aforementioned functional groups, the hydrogen atom may be substituted with any one of the aforementioned functional groups. Examples of such functional groups include an alkylcarbonylaminosulfonyl group, an arylcarbonylaminosulfonyl group, an alkylsulfonylaminocarbonyl group and an arylsulfonylaminocarbonyl group. Specific examples thereof include methylsulfonylaminocarbonyl, p-methylphenylsulfonylaminocarbonyl, acetylaminosulfonyl and benzoylaminosulfonyl group.

In Formula (1), $R^1$ and $R^2$ may be the same or different, or they may be bonded together to form a saturated or unsaturated carbon ring or heterocyclic ring.

In Formula (1), $R^1$—C—$R^2$ is preferably has a coupler structure known in the field of silver halide photographic materials. In this case, C corresponds to the coupling site with a developing agent. Examples of the coupler for photography are explained in Nobuo Furudachi, "Organic Compounds for Conventional Color Photography" (Journal of Society of Organic Synthesis Chemistry, vol. 41, p.439, 1983).

In Formula (1), X represents a halogen atom, preferably, a chlorine atom, bromine atom or iodine atom, particularly preferably a chlorine atom or bromine atom.

In Formula (1), L represents a methylene group. The methylene group may have a substituent, and the substituent may be any substituent so long as it does not adversely affect photographic performance. For example, the substituents mentioned as examples of the substituents represented by $R^1$ and $R^2$ may be used. Among such substituents, preferred are a linear, branched or cyclic alkyl group or an alkyl group consisting of a combination thereof (having preferably 1–20 carbon atoms, more preferably 1–16 carbon atoms, particularly preferably 1–8 carbon atoms, e.g., methyl, ethyl, isopropyl etc.), and an aryl group (having preferably 6–30 carbon atoms, more preferably 6–20 carbon atoms, particularly preferably 6–12 carbon atoms, e.g., phenyl, p-methylphenyl etc.), and further preferred is a linear, branched or cyclic alkyl group or an alkyl group consisting of a combination thereof. Particularly preferably, L is an unsubstituted methylene group.

In Formula (1), m represents an integer of 0–7, preferably an integer of 0–5, particularly preferably 0, 1 or 2.

In Formula (1), Y represents a divalent bridging group. Y preferably contains a hetero atom such as oxygen, nitrogen and sulfur, and this hetero atom preferably binds to L. n represents 0 or 1.

Specific examples of Y will be mentioned below. However, the present invention is not limited to these. In these examples, * represents a bonding site in L.

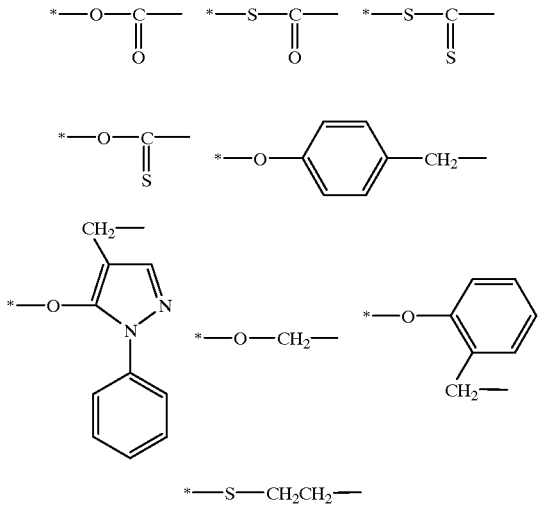

In Formula (1), Z represents a residue derived from a photographically useful compound, and Z preferably binds to L or Y via a hetero atom (oxygen, nitrogen, sulfur etc.) in the molecule. Examples of the photographically useful compound include antifoggaints and development inhibitors known in the field of silver halide photographic materials, for example, heteromercapto compounds that form a stable salt with silver ion, such as mercaptotetrazoles, mercaptotriazoles, mercaptoimidazoles, mercaptobenzothiazoles, mercaptobenzimidazoles, mercaptopyrimidines, mercaptooxadiazoles, thiouracils, mercaptothiadiazole, nitrogen-containing heterocyclic aromatic compounds such as benzotriazoles, indazoles, salicylic acid compounds, carboxylic acids and thiosulfonic acids described in U.S. Pat. Nos. 4,152,160, 4,784,939, 4,569,906, 4,820,617 and 4,626,500, and so forth.

Examples of the photographically useful compound further include known development accelerators known in the field of silver halide photographic materials, specifically, hydroxamic acids, polyhydroxybenzenes, aminophenols, hindered phenols, phenidones, sulfonamidophenols, and reducing compounds mentioned in U.S. Pat. No. 5,545,507. Examples of the photographically useful compound further include known dyes and leuco dyes known in the field of photography.

Specific examples of the compound represented by Formula (1) used in the present invention will be shown below. However, the present invention is not limited to these.

(C-1)

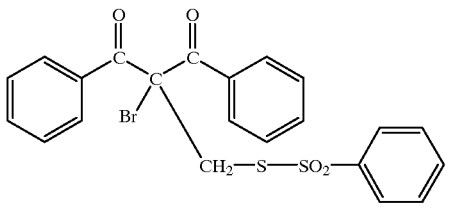

-continued
(C-2)
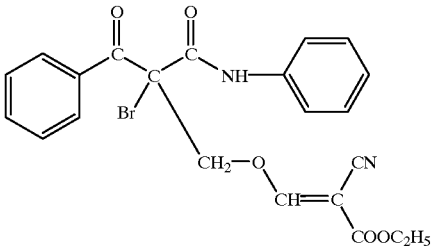
(C-3)
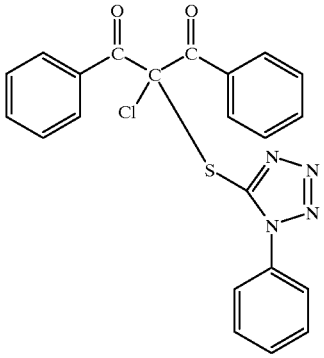
(C-4)
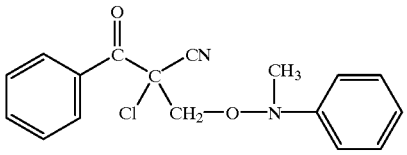
(C-5)
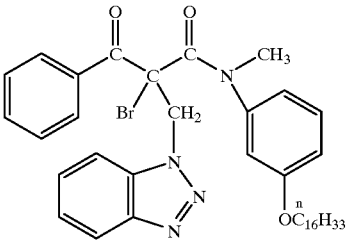
(C-6)
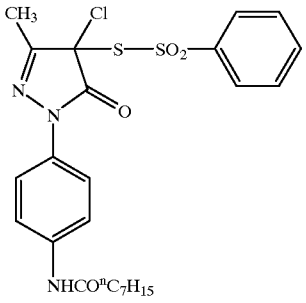
-continued
(C-7)
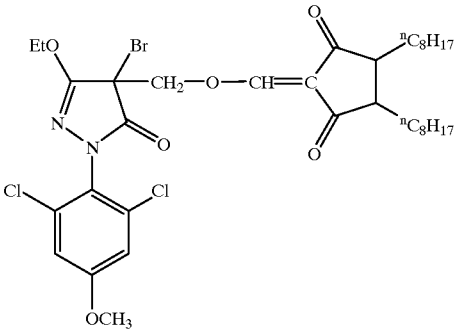
(C-8)
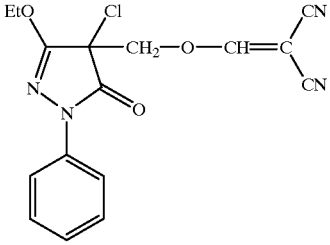
(C-9)
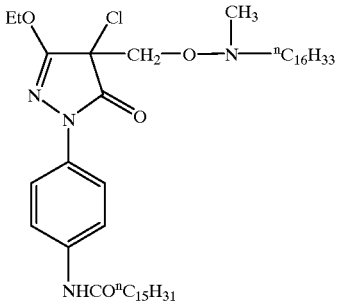
(C-10)
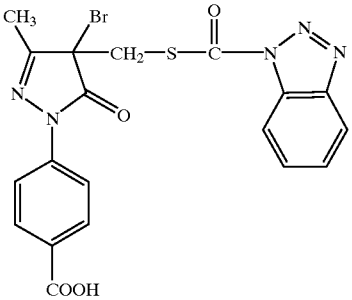
(C-11)
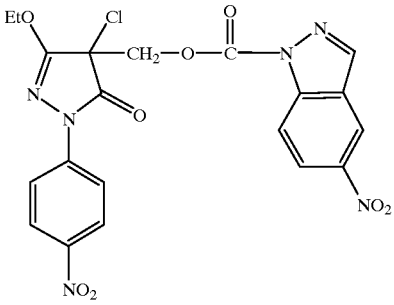

-continued
(C-12)
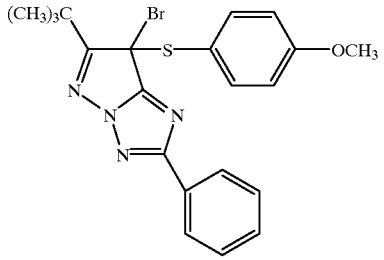
(C-13)
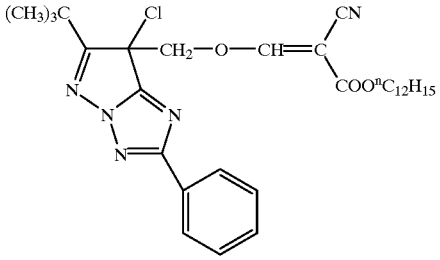
(C-14)
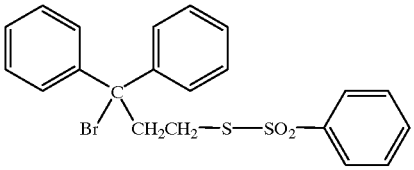
(C-15)
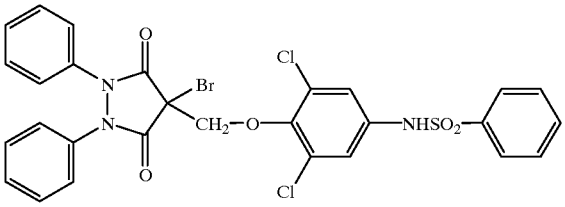
(C-16)
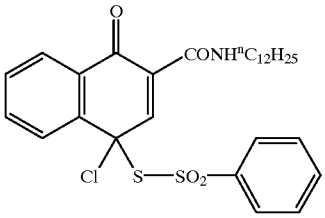
(C-17)
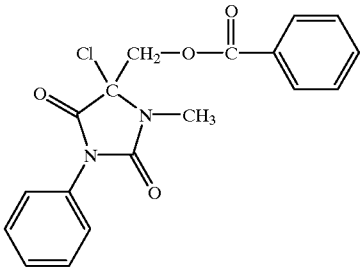
-continued
(C-18)
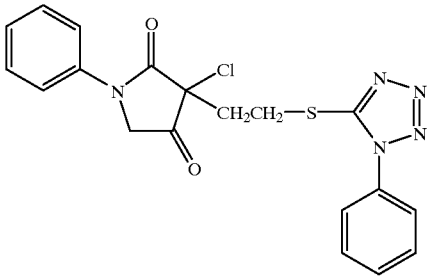
(C-19)
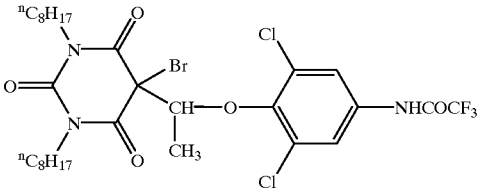
(C-20)
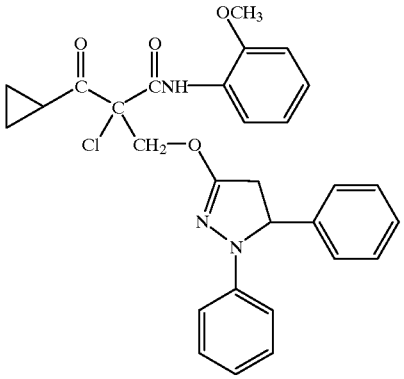
(C-21)
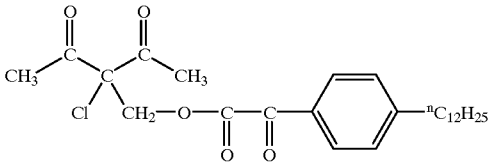
(C-22)
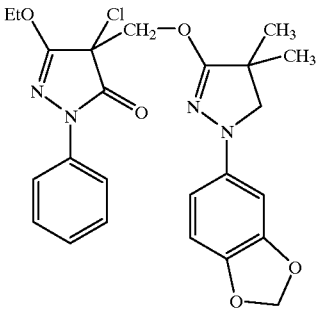

-continued (C-23)

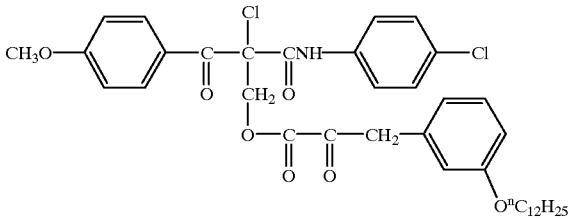

(C-24)

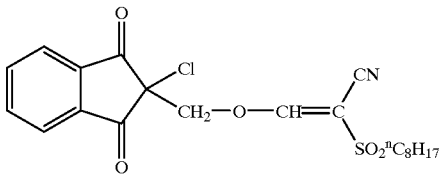

(C-25)

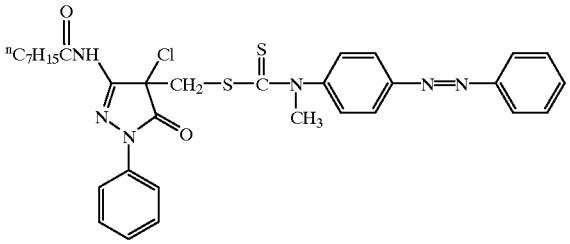

(C-26)

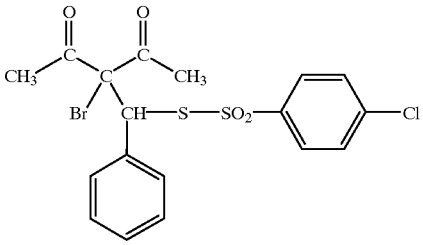

(C-27)

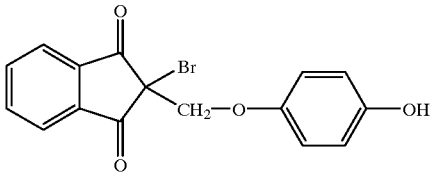

(C-28)

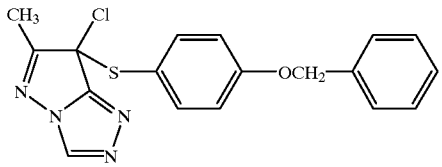

-continued (C-29)

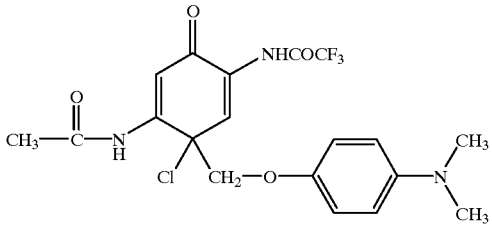

(C-30)

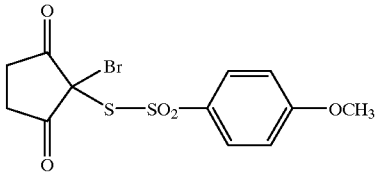

The compounds in which $R^1$—C—$R^2$ constitutes a coupler, which are particularly preferred compounds for the present invention, can be synthesized by introducing a bridging group into a coupler, then introducing Z and replacing the remaining active hydrogen atom with a halogen. A specific synthesis example will be shown below.

Synthesis of Exemplary Compound C-3

Compound A was synthesized by a method described in literature (Helv. Chim. Acta., 57, 7, 2201–2209, 1974). In an amount of 30.0 g of Compound A, 26.7 g of Compound B, which is commercially available, 20.9 mL of triethylamine and 300 mL of dimethylformamide were mixed and stirred at 50° C. for 2 hours. The reaction mixture was added to 2 L of ice water, and the deposited crystals were taken by filtration. The crystals were recrystallized from acetonitrile. As a result, 8.2 g of Compound C was obtained. A mixture of 8.0 g of Compound C and 100 mL of trimethyl phosphate was added dropwise with 2.0 mL of sulfuryl chloride, and stirred at 50° C. for 1 hour. The reaction mixture was added with 500 mL of water, and the deposited crystals were taken by filtration. The crystals were recrystallized from acetonitrile. As a result, 2.5 g of Compound C-3 was obtained.

Structure of the compound is shown below.

Compound A

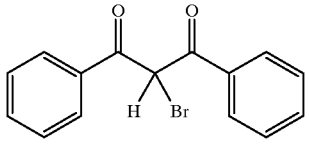

Compound B

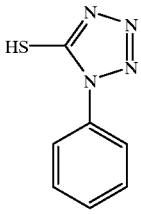

-continued

Compound C

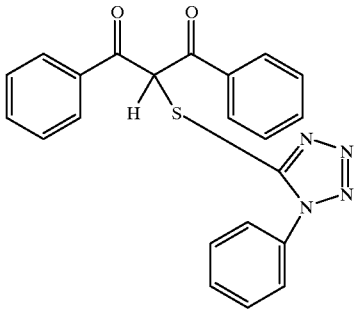

Compound C-3

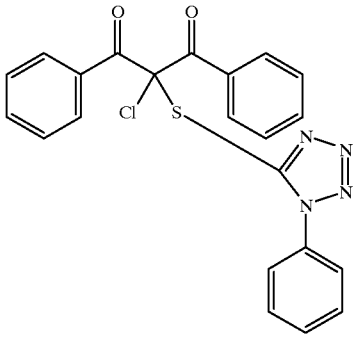

The compound of Formula (1) used in the present invention may be used after being dissolved in water or an appropriate organic solvent such as alcohols (e.g., methanol, ethanol, propanol, fluorinated alcohol), ketones (e.g., acetone, methyl ethyl ketone), dimethylformamide, dimethyl sulfoxide or methyl cellosolve.

Alternatively, it may also be used as an emulsified dispersion mechanically prepared according to a known emulsification dispersion method by using an oil such as dibutyl phthalate, tricresyl phosphate, glyceryl triacetate or diethyl phthalate, ethyl acetate or cyclohexanone as an auxiliary solvent for dissolution. Or, it may be used after dispersion of powder of the compound in water by using a ball mill, colloid mill, sand grinder mill, MANTON GAULIN, or microfluidizer, or by means of ultrasonic wave according to a known method for solid dispersion.

The compound of Formula (1) used for the present invention may be added to any layers on the same side of a support as the image-forming layer. It is preferably added to a layer containing the silver salt or a layer adjacent therefor.

While the amount of the compound of Formula (1) used for the present invention may vary depending on the type of photographically useful group, it is preferably from $1\times10^{-6}$ to 1 mole, more preferably from $1\times10^{-5}$ to $5\times10^{-1}$ mole, most preferably from $2\times10^{-5}$ to $2\times10^{-1}$ mole, per one mole of silver.

The compound of Formula (1) may be used as a single kind of the compound or a combination of two or more kinds of the compounds.

While type of the image recording material of the present invention characterized by using the compound represented by Formula (1) is not particularly limited, it may be, for example, a recording material for forming images with a development solution, a thermally processed image recording material for forming images by heat development after exposing it imagewise, or the like. It is preferably a thermally processed image recording material.

Hereafter, the thermally processed image recording material constituting a preferred embodiment of the present invention will be explained.

The thermally processed image recording material usually contains a silver salt of an organic acid as a reducible silver salt. The silver salt of an organic acid that can be used for the present invention is a silver salt relatively stable against light, but forms a silver image when it is heated at 80° C. or higher in the presence of an exposed photocatalyst (e.g., a latent image of photosensitive silver halide) and a reducing agent. The silver salt of an organic acid may be any organic substance containing a source of reducible silver ions. Silver salts of an organic acid, in particular, silver salts of a long chain aliphatic carboxylic acid having from 10 to 30, preferably from 15 to 28 carbon atoms, are preferred. Complexes of organic or inorganic acid silver salts of which ligands have a complex stability constant in the range of 4.0–10.0 are also preferred. The silver supplying substance can preferably constitute about 5–70 weight % of the image-forming layer. Preferred examples of the silver salts of an organic acid include silver salts of organic compounds having carboxyl group. Specifically, the silver salts of an organic acid may be silver salts of an aliphatic carboxylic acid and silver salts of an aromatic carboxylic acid, but not limited to these. Preferred examples of the silver salts of an aliphatic carboxylic acid include silver behenate, silver arachidinate, silver stearate, silver oleate, silver laurate, silver caproate, silver myristate, silver palmitate, silver maleate, silver fumarate, silver tartrate, silver linoleate, silver butyrate, silver camphorate, mixtures thereof and so forth.

In the present invention, there is preferably used silver salt of an organic acid having a silver behenate content of 75 mole % or more, more preferably silver salt of an organic acid having a silver behenate content of 85 mole % or more, among the aforementioned silver salts of an organic acid and mixtures of silver salts of an organic acid. The silver behenate content used herein means a molar percentage of silver behenate with respect to silver salt of an organic acid to be used. As silver salts of an organic acid other than silver behenate contained in the silver salts of organic acid used for the present invention, the silver salts of an organic acid exemplified above can preferably be used.

Silver salts of an organic acid that can be preferably used in the present invention can be prepared by allowing a solution or suspension of an alkali metal salt (e.g., Na salts, K salts, Li salts) of the aforementioned organic acids to react with silver nitrate. As the preparation method, the method described in Japanese Patent Application No. 11-104187, paragraphs 0019–0021 can be used.

In the present invention, a method of preparing a silver salt of an organic acid by adding an aqueous solution of silver nitrate and a solution of alkali metal salt of an organic acid to a sealable means for mixing liquids can preferably be used. Specifically, the method described in Japanese Patent Application No. 11-203413 can be used.

In the present invention, a dispersing agent soluble in water can be added to the aqueous solution of silver nitrate and the solution of alkali metal salt of an organic acid or reaction mixture, when the silver salt of an organic acid is prepared. Type and amount of the dispersing agent used in this case are specifically mentioned in Japanese Patent Application No. 11-115457, paragraph 0052.

The silver salt of an organic acid for use in the present invention is preferably prepared in the presence of a tertiary alcohol. The tertiary alcohol preferably has a total carbon number of 15 or less, more preferably 10 or less. Examples of preferred tertiary alcohols include tert-butanol. However, tertiary alcohol that can be used for the present invention is not limited to it.

The tertiary alcohol for use in the present invention may be added at any time during the preparation of the organic acid silver salt, but the tertiary alcohol is preferably used by adding at the time of preparation of the organic acid alkali metal salt to dissolve the organic acid alkali metal salt. The tertiary alcohol for use in the present invention may be added in any amount of from 0.01–10 in terms of the weight ratio to water used as a solvent for the preparation of the silver salt of an organic acid, but preferably added in an amount of from 0.03–1 in terms of weight ratio to water.

Although shape and size of the organic acid silver salt that can be used for the present invention are not particularly limited, those mentioned in Japanese Patent Application No. 11-104187, paragraph 0024 can be preferably used. The shape of the organic acid silver salt can be determined from a transmission electron microscope image of organic silver salt dispersion. An example of the method for determining monodispesibility is a method comprising obtaining standard deviation of volume weight average diameter of the organic acid silver salt. The percentage of a value obtained by dividing standard deviation by volume weight average diameter (variation coefficient) is preferably 80% or less, more preferably 50% or less, particularly preferably 30% or less. As for the measurement method, for example, the grain size can be determined by irradiating organic acid silver salt dispersed in a solution with a laser ray and determining an autocorrelation function for change of the fluctuation of the scattered light with time (volume weight average diameter). The average grain size determined by this method is preferably from 0.05–10.0 $\mu$m, more preferably from 0.1–5.0 $\mu$m, further preferably from 0.1–2.0 $\mu$m, as grains in solid grain dispersion.

The silver salt of an organic acid that can be used in the present invention is preferably desalted. The desalting method is not particularly limited and any known methods may be used. Known filtration methods such as centrifugal filtration, suction filtration, ultrafiltration and flocculation washing by coagulation may be preferably used. As the method of ultrafiltration, the method described in Japanese Patent Application No. 11-115457 can be used.

In the present invention, for obtaining an organic acid silver salt solid dispersion having a high S/N ratio and a small grain size and being free from coagulation, there is preferably used a dispersion method comprising steps of converting an aqueous dispersion that contains a silver salt of an organic acid as an image-forming medium and contains substantially no photosensitive silver salt into a high-speed flow, and then releasing the pressure. As such a dispersion method, the method mentioned in Japanese Patent Application No. 11-104187, paragraphs 0027–0038 can be used.

The grain size distribution in the organic acid silver salt solid grain dispersion preferably corresponds to monodispersion. Specifically, the percentage (variation coefficient) of the value obtained by dividing standard deviation of volume weight average diameter by volume weight average diameter (variation coefficient) is preferably 80% or less, more preferably 50% or less, particularly preferably 30% or less.

The organic acid silver salt solid grain dispersion used for the present invention consists of a silver salt of an organic acid and water. While the ratio of the silver salt of an organic acid and water is not particularly limited, the ratio of the silver salt of an organic acid is preferably in the range of 5–50 weight %, particularly preferably 10–30 weight %, with respect to the total weight. While it is preferred that the aforementioned dispersing aid should be used, it is preferably used in a minimum amount within a range suitable for minimizing the grain size, and it is preferably used in an amount of 0.5–30 weight %, particularly preferably 1–15 weight %, with respect to the silver salt of an organic acid.

The silver salt of an organic acid for use in the present invention may be used in any desired amount. However, it is preferably used in an amount of from 0.1–5 g/m$^2$, more preferably from 1–3 g/m$^2$, in terms of silver amount.

In the present invention, metal ions selected from Ca, Mg, Zn and Ag are preferably added to the non-photosensitive silver salt of an organic acid. The metal ions selected from Ca, Mg, Zn and Ag are preferably added to the non-photosensitive silver salt of an organic acid in the form of a water-soluble metal salt, not a halide compound. Specifically, they are preferably added in the form of nitrate or sulfate. Addition of halide is not preferred, since it degrades image storability, i.e., so-called printing-out property, of the photosensitive material against light (indoor light, sun light etc.) after the development. Therefore, in the present invention, it is preferable to add the ions in the form of water-soluble metal salts, which are not the aforementioned halide compound.

The metal ions selected from Ca, Mg, Zn and Ag, which are preferably used in the present invention, may be added any time after the formation of non-photosensitive organic acid silver salt grains and immediately before the coating operation, for example, immediately after the formation of grains, before dispersion, after dispersion, before and after the formation of coating solution and so forth. They are preferably added after dispersion, or before or after the formation of coating solution.

In the present invention, the metal ions selected from Ca, Mg, Zn and Ag are preferably added in an amount of $10^{-3}$ to $10^{-1}$ mole, particularly $5\times10^{-3}$ to $5\times10^{-2}$ mole, per one mole of non-photosensitive silver salt of an organic acid.

The image recording material of the present invention contains a photosensitive silver halide. The photosensitive silver halide used for the present invention is not particularly limited as for the halogen composition, and silver chloride, silver chlorobromide, silver bromide, silver iodobromide, silver chloroiodobromide and so forth may be used. As for the preparation of grains of the photosensitive silver halide emulsion, the grains can be prepared by the method described in JP-A-11-119374, paragraphs 0217–0224. However, the method is not particularly limited to this method.

Examples of the form of silver halide grains include a cubic form, octahedral form, tetradecahedral form, tabular form, spherical form, rod-like form, potato-like form and so forth. In particular, cubic grains and tabular grains are preferred for the present invention. As for the characteristics of the grain form such as aspect ratio and surface index of the grains, they may be similar to those described in JP-A-11-119374, paragraph 0225. Further, the halogen composition may have a uniform distribution in the grains for the internal portion and surface portion, or the composition may change stepwise or continuously in the grains. Silver halide grains having a core/shell structure may also be preferably used. Core/shell grains having preferably a double to quintuple structure, more preferably a double to quadruple structure may be used. A technique for localizing silver bromide on the surfaces of silver chloride or silver chlorobromide grains may also be preferably used.

As for the grain size distribution of the silver halide grains used in the present invention, the grains show monodispersion degree of 30% or less, preferably 1–20%, more preferably 5–15%. The monodispersion degree used herein is defined as a percentage (%) of a value obtained by dividing standard deviation of grain size by average grain size (variation coefficient). The grain size of the silver halide grains is represented as a ridge length for cubic grains, or a diameter of projected area as circle for the other grains (octahedral grains, tetradecahedral grains, tabular grains and so forth) for convenience.

The photosensitive silver halide grains used in the present invention preferably contain a metal of Group VII or Group VIII in the periodic table of elements or a complex of such a metal. The metal or the center metal of the complex of a metal of Group VII or Group VIII of the periodic table is preferably rhodium, rhenium, ruthenium, osmium or iridium. Particularly preferred metal complexes are $(NH_4)_3Rh(H_2O)Cl_5$, $K_2Ru(NO)Cl_5$, $K_3IrCl_6$ and $K_4Fe(CN)_6$. The metal complexes may be used each alone, or two or more kinds of complexes of the same or different metals may also be used in combination. The metal complex content is preferably from $1\times10^{-9}$ to $1\times10^{-3}$ mole, more preferably $1\times10^{-8}$ to $1\times10^{-4}$ mole, per mole of silver. As for specific structures of metal complexes, metal complexes of the structures described in JP-A-7-225449 and so forth can be used. Types and addition methods of these heavy metals and complexes thereof are described in JP-A-11-119374, paragraphs 0227–0240.

The photosensitive silver halide grains may be desalted by washing methods with water known in the art, such as the noodle washing and flocculation. However, the grain may not be desalted in the present invention.

The photosensitive silver halide grains used in the present invention are preferably subjected to chemical sensitization. For the chemical sensitization, the method described in JP-A-11-119374, paragraphs 0242–0250 can preferably be used.

Silver halide emulsions used in the present invention may be added with thiosulfonic acid compounds by the method described in European Patent Publication (hereinafter referred to as EP-A) 293917.

As gelatin used with the photosensitive silver halide used in the present invention, low molecular weight gelatin is preferably used in order to maintain good dispersion state of the silver halide emulsion in a coating solution containing a silver salt of an organic acid. The low molecular weight gelatin has a molecular weight of 500–60,000, preferably 1,000–40,000. While such low molecular weight gelatin may be added during the formation of grains or dispersion operation after the desalting treatment, it is preferably added during dispersion operation after the desalting treatment. It is also possible to use ordinary gelatin (molecular weight of about 100,000) during the grain formation and use low molecular gelatin,during dispersion operation after the desalting treatment.

While the concentration of dispersion medium may be 0.05–20 weight %, it is preferably in the range of 5–15 weight % in view of handling. As for type of gelatin, alkali-treated gelatin is usually used. Besides that, however, modified gelatin such as acid-treated gelatin and phthalated gelatin can also be used.

In the present invention, one kind of photosensitive silver halide emulsion may be used or two or more different emulsions (for example, those having different average grain sizes, different halogen compositions, different crystal habits or those subjected to chemical sensitization under different conditions) may be used in combination.

The amount of the photosensitive silver halide per mole of the silver salt of an organic acid is preferably from 0.01–0.5 mole, morepreferably from 0.02–0.3 mole, still more preferably from 0.03–0.25 mole. Methods and conditions for mixing photosensitive silver halide and silver salt of an organic acid, which are prepared separately, are not particularly limited so long as the effect of the present invention can be attained satisfactorily. Examples thereof include, for example, a method of mixing silver halide grains and silver salt of an organic acid after completion of respective preparations by using a high-speed stirring machine, ball mill, sand mill, colloid mill, vibrating mill, homogenizer or the like, and a method of preparing a silver salt of an organic acid with mixing a photosensitive silver halide obtained separately at any time during the preparation of the silver salt of an organic acid. For the mixing of them, mixing two or more kinds of aqueous dispersions of the silver salt of an organic acid and two or more kinds of aqueous dispersions of the photosensitive silver salt is preferably used for controlling photographic properties.

The image recording material of the present invention preferably contains an ultrahigh contrast agent.

While type of the ultrahigh contrast agent that can be used in the present invention is not particularly limited, examples of preferred ultrahigh contrast agents include the hydrazine derivatives represented by the formula (H) mentioned in Japanese Patent Application No. 11-87297 (specifically, the hydrazine derivatives mentioned in Tables 1–4 of the same), and all of the hydrazine derivatives described in JP-A-10-10672, JP-A-10-161270, JP-A-10-62898, JP-A-9-304870, JP-A-9-304872, JP-A-9-304871, JP-A-10-31282, U.S. Pat. No. 5,496,695 and EP-A-741320.

The substituted alkene derivatives, substituted isoxazole derivatives and particular acetal compounds represented by the formulas (1) to (3) mentioned in Japanese Patent Application No. 11-87297, and more preferably, the cyclic compounds represented by the formula (A) or (B) mentioned in the same, specifically Compounds 1–72 mentioned in Chem. 8 to Chem. 12 of the same may be also used. Two or more of these ultrahigh contrast agents may be used in combination.

The ultrahigh contrast agent may be used after being dissolved in water or an appropriate organic solvent such as alcohols (e.g., methanol, ethanol, propanol, fluorinated alcohol), ketones (e.g., acetone, methyl ethyl ketone), dimethylformamide, dimethyl sulfoxide or methyl cellosolve.

Further, it may also be used as an emulsion dispersion mechanically prepared according to an already well known emulsion dispersion method by using an oil such as dibutyl phthalate, tricresyl phosphate, glyceryl triacetate or diethyl phthalate, ethyl acetate or cyclohexanone as an auxiliary solvent for dissolution. Alternatively, the ultrahigh contrast agent may be used by dispersing powder of the ultrahigh contrast agent in a suitable solvent such as water using a ball mill, colloid mill, or by means of ultrasonic wave according to a known method for solid dispersion.

While the ultrahigh contrast agent may be added to any layer on the image-forming layer side, it is preferably added to the image-forming layer or a layer adjacent thereto.

The amount of the ultrahigh contrast agent is preferably $1\times10^{-6}$ mole to 1 mole, more preferably from $1\times10^{-5}$ mole to $5\times10^{-1}$ mole, most preferably from $2\times10^{-5}$ mole to $2\times10^{-1}$ mole, per mole of silver.

In addition to the aforementioned compounds, the compounds disclosed in U.S. Pat. Nos. 5,545,515, 5,635,339, 5,654,130, International Patent Publication WO97/34196 and U.S. Pat. No. 5,686,228, and the compounds disclosed in JP-A-11-119372, Japanese Patent Application No. 9-309813, JP-A-11-119373, Japanese Patent Application No. 9-282564, JP-A-11-95365, JP-A-11-95366 and Japanese Patent Application No. 9-332388 may also be used.

In the present invention, a contrast accelerator may be used in combination with the above-described ultrahigh contrast agent for the formation of an ultrahigh contrast image. For example, amine compounds described in U.S. Pat. No. 5,545,505, specifically, AM-1 to AM-5; hydroxamic acids described in U.S. Pat. No. 5,545,507, specifically, HA-1 to HA-11; acrylonitriles described in U.S. Pat. No. 5,545,507, specifically, CN-1 to CN-13; hydrazine compounds described in U.S. Pat. No. 5,558,983, specifically, CA-1 to CA-6; and onium salts described in JP-A-9-297368, specifically, A-1 to A-42, B-1 to B-27 and C-1 to C-14 and so forth may be used.

Formic acid and formic acid salts serve as a strongly fogging substance in a thermally processed image recording material containing a non-photosensitive silver salt, a photosensitive silver halide and a binder. In the present invention, the thermally processed image recording material preferably contains formic acid or a formic acid salt on the side having the image-forming layer containing a photosensitive silver halide in an amount of 5 mmol or less, more preferably 1 mmol or less, per 1 mole of silver.

In the thermally processed image recording material the present invention, an acid formed by hydration of diphosphorus pentoxide or a salt thereof is preferably used together with the ultrahigh contrast agent. Examples of the acid formed by hydration of diphosphorus pentoxide or salts thereof include metaphosphoric acid (salt), pyrophosphoric acid (salt), orthophosphoric acid (salt), triphosphoric acid (salt), tetraphosphoric acid (salt), hexametaphosphoric acid (salt) and so forth. Particularly preferably used acids formed by hydration of diphosphorus pentoxide or salts thereof are orthophosphoric acid (salt) and hexametaphosphoric acid (salt). Specific examples of the salt are sodium orthophosphate, sodium dihydrogenorthophosphate, sodium hexametaphosphate, ammonium hexametaphosphate and so forth.

The acid formed by hydration of diphosphorus pentoxide or a salt thereof that can be preferably used in the present invention is added to the image-forming layer or a binder layeradjacent thereto in order to obtain the desired effect with a small amount of the acid or a salt thereof.

The acid formed by hydration of diphosphorus pentoxide or a salt thereof may be used in a desired amount (coated amount per $m^2$ of the image recording material) depending on the desired performance including sensitivity and fog. However, it can preferably be used in an amount of 0.1–500 $mg/m^2$, more preferably 0.5–100 $mg/m^2$.

The image recording material of the present invention preferably contains a reducing agent for the silver salt of an organic acid. The reducing agent for the silver salt of an organic acid may be any substance that reduces silver ion to metal silver, preferably such an organic substance. Conventional photographic developers such as phenidone, hydroquinone and catechol are useful, but a hindered phenol reducing agent is preferred. The reducing agent is preferably contained in an amount of from 5–50 mole %, more preferably from 10–40 mole %, per mole of silver on the side having the image-forming layer. The reducing agent may be added to any layer on the side having an image-forming layer. In the case of adding the reducing agent to a layer other than the image-forming layer, the reducing agent is preferably used in a slightly large amount of from 10–50 mole % per mole of silver. The reducing agent may also be a so-called precursor that is derived to effectively function only at the time of development.

For thermally processed image recording materials using a silver salt of an organic acid, reducing agents of a wide range may be used. For example, there can be used reducing agents disclosed in, for example, JP-A-46-6074, JP-A-47-1238, JP-A-47-33621, JP-A-49-46427, JP-A-49-115540, JP-A-50-14334, JP-A-50-36110, JP-A-50-147711, JP-A-51-32632, JP-A-51-1023721, JP-A-51-32324, JP-A-51-51933, JP-A-52-84727, JP-A-55-108654, JP-A-56-146133, JP-A-57-82828, JP-A-57-82829, JP-A-6-3793, U.S. Pat. Nos. 3,679,426, 3,751,252, 3,751,255, 3,761,270, 3,782,949, 3,839,048, 3,928,686 and 5,464,738, German Patent No. 2,321,328, EP-A-692732 and so forth. Examples thereof include amidoximes such as phenylamidoxime, 2-thienylamidoxime and p-phenoxyphenylamidoxime; azines such as 4-hydroxy-3,5-dimethoxybenzaldehyde azine; combinations of an aliphatic carboxylic acid arylhydrazide with ascorbic acid such as a combination of 2,2-bis(hydroxymethyl)propionyl-β-phenylhydrazine with ascorbic acid; combinations of polyhydroxybenzene with hydroxylamine, reductone and/or hydrazine such as a combination of hydroquinone with bis(ethoxyethyl) hydroxylamine, piperidinohexose reductone or formyl-4-methylphenylhydrazine; hydroxamic acids such as phenylhydroxamic acid, p-hydroxyphenylhydroxamic acid and β-anilinehydroxamic acid; combinations of an azine with a sulfonamidophenol such as a combination of phenothiazine with 2,6-dichloro-4-benzenesulfonamidophenol; α-cyanophenylacetic acid derivatives such as ethyl-α-cyano-2-methylphenylacetate and ethyl-α-cyanophenylacetate; bis-β-naphthols such as 2,2'-dihydroxy-1,1'-binaphthyl, 6,6'-dibromo-2,2'-dihydroxy-1,1'-binaphthyl and bis(2-hydroxy-1-naphthyl)methane; combinations of a bis-β-naphthol with a 1,3-dihydroxybenzene derivative (e.g., 2,4-dihydroxybenzophenone, 2',4'-dihydroxyacetophenone); 5-pyrazolones such as 3-methyl-1-phenyl-5-pyrazolone; reductones such as dimethylaminohexose reductone, anhydrodihydroaminohexose reductone and anhydrodihydropiperidonehexose reductone; sulfonamidophenol reducing agents such as 2,6-dichloro-4-benzenesulfonamidophenol and p-benzenesulfonamidophenol; 2-phenylindane-1,3-diones; chromans such as 2,2-dimethyl-7-tert-butyl-6-hydroxychroman; 1,4-dihydropyridines such as 2,6-dimethoxy-3,5-dicarboethoxy-1,4-dihydropyridine; bisphenols such as bis(2-hydroxy-3-tert-butyl-5-methylphenyl)methane, 2,2-bis(4-hydroxy-3-methylphenyl) propane, 4,4-ethylidene-bis(2-tert-butyl-6-methylphenol), 1,1-bis(2-hydroxy-3,5-dimethylphenyl)-3,5,5-trimethylhexane and 2,2-bis(3,5-dimethyl-4-hydroxyphenyl)propane; ascorbic acid derivatives such as 1-ascorbyl palmitate and ascorbyl stearate; aldehydes and ketones such as benzyl and biacetyl; 3-pyrazolidone and a certain kind of indane-1,3-diones; chromanols such as tocopherol and so forth. Particularly preferred reducing agents are bisphenols and chromanols.

In the present invention, the reducing agent may be added in any form of aqueous solution, solution in an organic solvent, powder, solid microparticle dispersion, emulsion dispersion or the like. The solid microparticle dispersion is performed by using a known pulverizing means (e.g., ball mill, vibrating ball mill, sand mill, colloid mill, jet mill, rollermill). At the time of solid microparticle dispersion, a dispersion aid may also be used.

If an additive known as "toning agent" capable of improving images is added, the optical density increases in some cases. The toning agent may also be advantageous in forming a black silver image depending on the case. The toning agent is preferably contained in a layer on the side having the image-forming layer in an amount of from 0.1–50 mole %, more preferably from 0.5–20 mole %, per mole of silver. The toning agent may be a so-called precursor that is derived to effectively function only at the time of development.

For thermally processed image recording materials using a silver salt of an organic acid, toning agents of a wide range may be used. For example, there can be used those disclosed in JP-A-46-6077, JP-A-47-10282, JP-A-49-5019, JP-A-49-5020, JP-A-49-91215, JP-A-50-2524, JP-A-50-32927, JP-A-50-67132, JP-A-50-67641, JP-A-50-114217, JP-A-51-3223, JP-A-51-27923, JP-A-52-14788, JP-A-52-99813, JP-A-53-1020, JP-A-53-76020, JP-A-54-156524, JP-A-54-156525, JP-A-61-183642, JP-A-4-56848, JP-B-49-10727, JP-B-54-20333, U.S. Pat. Nos. 3,080,254, 3,446,648, 3,782,941, 4,123,282 and 4,510,236, British Patent No. 1,380,795, Belgian Patent No. 841910 and so forth. Specific examples of the toning agent include phthalimide and N-hydroxyphthalimide; succinimide, pyrazolin-5-ones and cyclic imides such as quinazolinone, 3-phenyl-2-pyrazolin-5-one, 1-phenylurazole, quinazoline and 2,4-thiazolidinedione; naphthalimides such as N-hydroxy-1,8-naphthalimide; cobalt complexes such as cobalt hexaminetrifluoroacetate; mercaptanes such as 3-mercapto-1,2,4-triazole, 2,4-dimercaptopyrimidine, 3-mercapto-4,5-diphenyl-1,2,4-triazole and 2,5-dimercapto-1,3,4-thiadiazole; N-(aminomethyl)aryldicarboxyimides such as N,N-(dimethylaminomethyl)phthalimide and N,N-(dimethylaminomethyl)naphthalene-2,3-dicarboxyimide; blocked pyrazoles, isothiuronium derivatives and a certain kind of photobleaching agents such as N,N'-hexamethylenebis(1-carbamoyl-3,5-dimethylpyrazole), 1,8-(3,6-diazaoctane)bis(isothiuroniumtrifluoroacetate) and 2-(tribromomethylsulfonyl)benzothiazole; 3-ethyl-5 [(3-ethyl-2-benzothiazolinylidene)-1-methylethylidene]-2-thio-2,4-oxazolidine dione; phthalazinone, phthalazinone derivatives and metal salts thereof, such as 4-(1-naphthyl) phthalazinone, 6-chlorophthalazinone, 5,7-dimethyloxyphthalazinone or 2,3-dihydro-1,4-phthalazinedione; combinations of phthalazinone with a phthalic acid derivative (e.g., phthalic acid, 4-methylphthalic acid, 4-nitrophthalic acid, tetrachlorophthalic acid anhydride); phthalazine, phthalazine derivatives (e.g., 4-(1-naphthyl)phthalazine, 6-chlorophthalazine, 5,7-dimethoxyphthalazine, 6-iso-butylphthalazine, 6-tert-butylphthalazine, 5,7-dimethylphthalazine, 2,3-dihydrophthalazine) and metal salts thereof; combinations of phthalazine or a derivative thereof and a phthalic acid derivative (e.g., phthalic acid, 4-methylphthalic acid, 4-nitrophthalic acid, tetrachlorophthalic acid anhydride); quinazolinedione, benzoxazine and naphthoxazine derivatives; rhodium complexes which function not only as a toning agent but also as a halide ion source for the formation of silver halide at the site, such as ammonium hexachlororhodate(III), rhodium bromide, rhodium nitrate and potassium hexachlororhodate (III) ; inorganic peroxides and persulfates such as ammonium disulfide peroxide and hydrogen peroxide; benzoxazine-2,4-diones such as 1,3-benzoxazin-2,4-dione, 8-methyl-1,3-benzoxazin-2,4-dione and 6-nitro-1,3-benz-oxazin-2,4-dione; pyrimidines and asymmetric triazines such as 2,4-dihydroxpyrimidine and 2-hydroxy-4-aminopyrimidine; azauracil and tetraazapentalene derivatives such as 3,6-dimercapto-1,4-diphenyl-1H,4H-2,3a,5,6a-tetraazapent alene and 1,4-di(o-chlorophenyl)-3,6-dimercapto-1H,4H-2, 3a,5,6a-tetraazapentalene and so forth.

In the present invention, the phthalazine derivatives represented by the formula (F) mentioned in Japanese Patent Application No. 10-213487 are preferably used as the toning agent. Specifically, A-1 to A-10 mentioned in the same are preferably used.

In the present invention, the toning agent may be added in any form of solution, powder, solid microparticle dispersion or the like. The solid microparticle dispersion is performed by using known pulverization means (e.g., ball mill, vibrating ball mill, sand mill, colloid mill, jet mill, roller mill). At the time of solid microparticle dispersion, a dispersion aid may also be used.

The thermally processed image recording material of the present invention preferably has a film surface pH of 6.0 or less, more preferably 5.5 or less, before heat development. While it is not particularly limited as for the lower limit, it is normally around 3 or higher.

For controlling the film surface pH, an organic acid such as phthalic acid derivatives or a nonvolatile acid such as sulfuric acid, and a volatile base such as ammonia are preferably used to lower the film surface pH. In particular, ammonia is preferred to achieve a low film surface pH, because it is highly volatile and therefore it can be removed before coating or heat development. A method for measuring the film surface pH is described in Japanese Patent Application No. 11-87297, paragraph 0123.

The silver halide emulsion and/or the silver salt of an organic acid for use in the thermally processed image recording material of the present invention can be further prevented from the generation of additional fog or stabilized against the reduction in sensitivity during the stock storage, by an antifoggant, a stabilizer or a stabilizer precursor. Examples of suitable antifoggant, stabilizer and stabilizer precursor that can be used individually or in combination include the thiazonium salts described in U.S. Pat. Nos. 2,131,038 and 2,694,716, azaindenes described in U.S. Pat. Nos. 2,886,437 and 2,444,605, mercury salts described in U.S. Pat. No. 2,728,663, urazoles described in U.S. Pat. No. 3,287,135, sulfocatechols described in U.S. Pat. No. 3,235,652, oximes, nitrons and nitroindazoles described in British Patent No. 623,448, polyvalent metal salts described in U.S. Pat. No. 2,839,405, thiuronium salts described in U.S. Pat. No. 3,220,839, palladium, platinum and gold salts described in U.S. Pat. Nos. 2,566,263 and 2,597,915, halogen-substituted organic compounds described in U.S. Pat. Nos. 4,108,665 and 4,442,202, triazines described in U.S. Pat. Nos. 4,128,557, 4,137,079, 4,138,365 and 4,459,350, phosphorus compounds described in U.S. Pat. No. 4,411,985 and so forth.

The image recording material of the present invention may contain a benzoic acid compound for the purpose of achieving high sensitivity or preventing fog. The benzoic acid compound for use in the present invention may be any benzoic acid derivative, but preferred examples thereof include the compounds described in U.S. Pat. Nos. 4,784,939 and 4,152,160 and JP-A-9-329863, JP-A-9-329864 and JP-A-9-281637. The benzoic acid compound for use in the present invention may be added to any layer of the thermally processed image recording material, but it is preferably added to a layer on the image-forming layer side, more preferably a layer containing a silver salt of an organic acid. The benzoic acid compound may be added at any step during the preparation of the coating solution. In the case of adding the benzoic acid compound to a layer containing a silver salt of an organic acid, it may be added at any step from the preparation of the silver salt of an organic acid to the preparation of the coating solution, but it is preferably added in the period after the preparation of the silver salt of an organic acid and immediately before the coating. The benzoic acid compound may be added in any form such as powder, solution and microparticle dispersion, or may be added as a solution containing a mixture of the benzoic acid compound with other additives such as a sensitizing dye, reducing agent and toning agent. The benzoic acid compound may be added in any amount. However, the addition amount thereof is preferably from $1\times10^{-6}$ to 2 mole, more preferably from $1\times10^{-3}$ to 0.5 mole, per mole of silver.

Although not essential for practicing the present invention, it is advantageous in some cases to add a mercury (II) salt as an antifoggant to the image-forming layer. Preferred mercury(II) salts for this purpose are mercury acetate and mercury bromide. The addition amount of mercury for use in the present invention is preferably from $1\times10^{-9}$ to $1\times10^{-3}$ mole, more preferably from $1\times10^{-8}$ to $1\times10^{-4}$ mole, per mole of coated silver.

The antifoggant that is particularly preferably used in the present invention is an organic halide, and examples thereof include the compounds described in JP-A-50-119624, JP-A-50-120328, JP-A-51-121332, JP-A-54-58022, JP-A-56-70543, JP-A-56-99335, JP-A-59-90842, JP-A-61-129642, JP-A-62-129845, JP-A-6-208191, JP-A-7-5621, JP-A-7-2781, JP-A-8-15809 and U.S. Pat. Nos. 5,340,712, 5,369,000 and 5,464,737.

The hydrophilic organic halides represented by the formula (P) mentioned in Japanese Patent Application No. 11-87297 can be preferably used as the antifoggant. Specifically, the compounds (P-1) to (P-118) mentioned in the same are preferably used.

The amount of the organic halides is preferably $1\times10^{-5}$ mole to 2 mole/mole Ag, more preferably $5\times10^{-5}$ mole to 1 mole/mole Ag, further preferably $1\times10^{-4}$ mole to $5\times10^{-1}$ mole/mole Ag, in terms of molar amount per mole of Ag (mole/mole Ag). The organic halides may be used each alone, or two or more of them may be used in combination.

Further, the salicylic acid derivatives represented by the formula (Z) mentioned in Japanese Patent Application No. 11-87297 can be preferably used as the antifoggant. Specifically, the compounds (A-1) to (A-60) mentioned in the same are preferably used. The amount of the salicylic acid represented by the formula (Z) is preferably $1\times10^{-5}$ mole to $5\times10^{-1}$ mole/mole Ag, more preferably $5\times10^{-5}$ mole to $1\times10^{-1}$ mole/mole Ag, further preferably $1\times10^{-5}$ mole to $5\times10^{-2}$ mole/mole Ag, in terms of molar amount per mole of Ag (mole/mole Ag). The salicylic acid derivatives may be used each alone, or two or more of them may be used in combination.

As antifoggants preferably used in the present invention, formalin scavengers are effective. Examples thereof include the compounds represented by the formula (S) and the exemplary compounds thereof (S-1) to (S-24) mentioned in Japanese Patent Application No. 11-23995.

The antifoggant used for the present invention may be used after being dissolved in water or an appropriate organic solvent such as alcohols (e.g., methanol, ethanol, propanol, fluorinated alcohol), ketones (e.g., acetone, methyl ethyl ketone), dimethylformamide, dimethyl sulfoxide or methyl cellosolve.

Further, it may also be used as an emulsion dispersion mechanically prepared according to an already well known emulsion dispersion method by using an oil such as dibutyl phthalate, tricresyl phosphate, glyceryl triacetate or diethyl phthalate, ethyl acetate or cyclohexanone as an auxiliary solvent for dissolution. Alternatively, it may be used by dispersing powder of it in a suitable solvent such as water using a ball mill, colloid mill, sand grinder mill, MANTON GAULIN, microfluidizer, or by means of ultrasonic wave according to a known method for solid dispersion.

While the antifoggant used in the present invention may be added to any layer on the image-forming layer side, that is, the image-forming layer or other layers on that side, it is preferably added to the image-forming layer or a layer adjacent thereto. In a thermally processed image recording material, the image-forming layer is a layer containing a reducible silver salt (silver salt of an organic acid), preferably such a image-forming layer further containing a photosensitive silver halide.

The image recording material of the present invention may contain a mercapto compound, disulfide compound or thione compound so as to control the development by inhibiting or accelerating the development or improve the storage stability before or after the development.

In the case of using a mercapto compound in the present invention, any structure may be used but those represented by Ar—SM or Ar—S—S—Ar are preferred, wherein M is hydrogen atom or an alkali metal atom, and Ar is an aromatic ring or condensed aromatic ring containing one or more nitrogen, sulfur, oxygen, selenium or tellurium atoms. The heteroaromatic ring is preferably selected from benzimidazole, naphthimidazole, benzothiazole, naphthothiazole, benzoxazole, naphthoxazole, benzoselenazole, benzotellurazole, imidazole, oxazole, pyrazole, triazole, thiadiazole, tetrazole, triazine, pyrimidine, pyridazine, pyrazine, pyridine, purine, quinoline and quinazolinone. The heteroaromatic ring may have a substituent selected from, for example, the group consisting of a halogen (e.g., Br, Cl), hydroxy, amino, carboxy, alkyl (e.g., alkyl having one or more carbon atoms, preferably from 1 to 4 carbon atoms), alkoxy (e.g., alkoxy having one or more carbon atoms, preferably from 1 to 4 carbon atoms) and aryl (which may have a substituent). Examples of the mercapto substituted heteroaromatic compound include 2-mercaptobenzimidazole, 2-mercaptobenzoxazole, 2-mercaptobenzothiazole, 2-mercapto-5-methylbenzimidazole, 6-ethoxy-2-mercaptobenzo-thiazole, 2,2'-dithiobis(benzothiazole), 3-mercapto-1,2,4-triazole, 4,5-diphenyl-2-imidazolethiol, 2-mercapto-imidazole, 1-ethyl-2-mercaptobenzimidazole, 2-mercapto-quinoline, 8-mercaptopurine, 2-mercapto-4(3H)-quinazoli-none, 7-trifluoromethyl-4-quinolinethiol, 2,3,5,6-tetra-chloro-4-pyridinethiol, 4-amino-6-hydroxy-2-mercapto-pyrimidine monohydrate, 2-amino-5-mercapto-1,3,4-thiadia-zole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methyl-pyrimidine hydrochloride, 3-mercapto-5-phenyl-1,2,4-triazole, 1-phenyl-5-mercaptotetrazole, sodium 3-(5-mercaptotetrazole)benzene-sulfonate, N-methyl-N'-{3-(5-mercaptotetrazolyl)phenyl}-urea, 2-mercapto-4-phenyloxazole and so forth. However, the present invention is not limited to these.

The amount of the mercapto compound is preferably from 0.0001–1.0 mole, more preferably from 0.001–0.3 mole, per mole of silver in the image-forming layer.

The thermally processed image recording material of the present invention preferably has an image-forming layer containing a silver salt of an organic acid, a reducing agent and a photosensitive silver halide on a support, and at least one protective layer is preferably provided on the image-forming layer. Further, the image recording material of the present invention preferably has at least one back layer on the side of the support opposite to the side of the image-forming layer (back surface), and polymer latex is used as binder of the image-forming layer, protective layer and back layer. The use of polymer latex for these layers enables coating with an aqueous system utilizing a solvent (dispersion medium) containing water as a main component. Not only this is advantageous for environment and cost, but also it makes it possible to provide thermally processed image recording materials that generate no wrinkle upon heat development. Further, by using a support subjected to a predetermined heat treatment, there are provided thermally processed image recording material exhibiting little dimensional change in sizes before and after the heat development.

As the binder used for the present invention, the polymer latex explained below is preferably used.

Among image-forming layers containing a photosensitive silver halide in the image recording material of the present invention, at least one layer is preferably an image-forming layer utilizing polymer latex to be explained below in an amount of 50 weight % or more with respect to the total amount of binder. The polymer latex may be used not only in the image-forming layer, but also in the protective layer, back layer or the like. When the image recording material of the present invention is used for, in particular, printing use in which dimensional change causes problems, the polymer latex is preferably used also in a protective layer and a back layer. The term "polymer latex" used herein means a dispersion comprising hydrophobic water-insoluble polymer dispersed in a water-soluble dispersion medium as fine particles. The dispersed state may be one in which polymer is emulsified in a dispersion medium, one in which polymer underwent emulsion polymerization, emulsion dispersion, micelle dispersion, one in which polymer molecules having a hydrophilic portion are dispersed in molecular state or the like. Polymer latex used in the present invention is described in "Gosei Jushi Emulsion (Synthetic Resin Emulsion)", compiled by Taira Okuda and Hiroshi Inagaki, issued by Kobunshi Kanko Kai (1978); "Gosei Latex no Oyo (Application of Synthetic Latex)", compiled by Takaaki Sugimura, Yasuo Kataoka, Souichi Suzuki and Keishi Kasahara, issued by Kobunshi Kanko Kai (1993); Soichi Muroi, "Gosei Latex no Kagaku (Chemistry of Synthetic Latex)", Kobunshi Kanko Kai (1970) and so forth. The dispersed particles preferably have an average particle size of about 1–50000 nm, more preferably about 5–1000 nm. The particle size distribution of the dispersed particles is not particularly limited, and the particles may have either wide particle size distribution or monodispersed particle size distribution.

The polymer latex used in the present invention may be latex of the so-called core/shell type, which is different from ordinary polymer latex of a uniform structure. In this case, use of different glass transition temperatures of the core and shell may be preferred.

Preferred range of the glass transition temperature (Tg) of the polymer latex preferably used as the binder in the present invention varies for the protective layer, back layer and image-forming layer. As for the image-forming layer, the glass transition temperature is preferably -30 to 40° C. for accelerating diffusion of photographic elements during the heat development. Polymer latex used for the protective layer or back layer preferably has a glass transition temperature of 25 to 70° C., because these layers are brought into contact with various apparatuses.

The polymer latex used in the present invention preferably shows a minimum film forming temperature (MFT) of about −30–90° C., more preferably about 0–70° C. A film-forming aid may be added in order to control the minimum film forming temperature. The film-forming aid is also referred to as a plasticizer, and consists of an organic compound (usually an organic solvent) that lowers the minimum film forming temperature of the polymer latex. It is explained in, for example, the aforementioned Soichi Muroi, "Gosei Latex no Kagaku (Chemistry of Synthetic Latex)", Kobunshi Kanko Kai (1970).

Examples of polymer species used for the polymer latex used in the present invention include acrylic resins, polyvinyl acetate resins, polyester resins, polyurethane resins, rubber resins, polyvinyl chloride resins, polyvinylidene chloride resins and polyolefin resins, copolymers of monomers constituting these resins and so forth. The polymers may be linear, branched or crosslinked. They may be so-called homopolymers in which a single kind of monomer is polymerized, or copolymers in which two or more different kinds of monomers are polymerized. The copolymers may be random copolymers or block copolymers. The polymers may have a number average molecular weight of 5,000 to 1,000,000, preferably from 10,000 to 100,000. Polymers having a too small molecular weight may unfavorably suffer from insufficient mechanical strength of the image-forming layer, and those having a too large molecular weight may unfavorably suffer from bad film forming property.

Examples of the polymer latex used as the binder of the image-forming layer of the photothermographic material of the present invention include latex of methyl methacrylate/ethyl acrylate/methacrylic acid copolymer, latex of methyl methacrylate/butadiene/itaconic acid copolymer, latex of ethyl acrylate/methacrylic acid copolymer, latex of methyl methacrylate/2-ethylhexyl acrylate/styrene/acrylic acid copolymer, latex of styrene/butadiene/acrylic acid copolymer, latex of styrene/butadiene/divinylbenzene/methacrylic acid copolymer, latex of methyl methacrylate/vinyl chloride/acrylic acid copolymer, latex of vinylidene chloride/ethyl acrylate/acrylonitrile/methacrylic acid copolymer and so forth. More specifically, there can be mentioned latex of methyl methacrylate (33.5 weight %)/ethyl acrylate (50 weight %)/methacrylic acid (16.5 weight %) copolymer, latex of methyl methacrylate (47.5 weight %)/butadiene (47.5 weight %)/itaconic acid (5 weight %) copolymer, latex of ethyl acrylate (95 weight %)/methacrylic acid (5 weight %) copolymer and so forth. Such polymers are also commercially available and examples thereof include acrylic resins such as CEBIAN A-4635, 46583, 4601 (all produced by Dicel Kagaku Kogyo Co., Ltd), Nipol Lx811, 814, 821, 820, 857 (all produced by Nippon Zeon Co., Ltd.), VONCORT R3340, R3360, R3370, 4280 (all produced by Dai-Nippon Ink & Chemicals, Inc.); polyester resins such as FINETEX ES650, 611, 675, 850 (all produced by Dai-Nippon Ink & Chemicals, Inc.), WD-size and WMS (both produced by Eastman Chemical); polyurethane resins such as HYDRAN AP10, 20, 30, 40 (all produced by Dai-Nippon Ink & Chemicals, Inc.); rubber resins such as LACSTAR 7310K, 3307B, 4700H, 7132C (all produced by Dai-Nippon Ink & Chemicals, Inc.), Nipol LX416, 410, 438C (all produced by Nippon Zeon Co., Ltd.); polyvinyl chloride resins such as G351, G576 (both produced by Nippon Zeon Co., Ltd.); polyvinylidene chloride resins such as L502, L513 (both produced by Asahi Chemical Industry Co., Ltd.), ARON D7020, D504, D5071 (all produced by Mitsui Toatsu Co., Ltd.); and olefin resins such as CHEMIPEARL S120 and SA100 (both produced by Mitsui Petrochemical Industries, Ltd.) and so forth. These polymers may be used individually or if desired, as a blend of two or more of them.

The image-forming layer preferably contains 50 weight % or more, more preferably 70 weight % or more of the aforementioned polymer latex based on the total binder.

If desired, the image-forming layer may contain a hydrophilic polymer in an amount of 50 weight % or less of the total binder, such as gelatin, polyvinyl alcohol, methyl cellulose, hydroxypropyl cellulose, carboxymethyl cellulose and hydroxypropylmethyl cellulose. The amount of the hydrophilic polymer is preferably 30 weight % or less, more preferably 15 weight % or less, of the total binder in the image-forming layer.

The image-forming layer is preferably formed by coating an aqueous coating solution and then drying the coating solution. The term "aqueous" as used herein means that water content of the solvent (dispersion medium) in the coating solution is 60 weight % or more. In the coating solution, the component other than water may be a water-miscible organic solvent such as methyl alcohol, ethyl alcohol, isopropyl alcohol, methyl cellosolve, ethyl cellosolve, dimethylformamide and ethyl acetate. Specific examples of the solvent composition include water/methanol=90/10, water/methanol=70/30, water/ethanol=90/10, water/isopropanol=90/10, water/dimethylformamide=95/5, water/methanol/dimethylformamide=80/15/5, and water/methanol/dimethylformamide=90/5/5 (the numerals indicate weight %).

The total amount of the binder in the image-forming layer is preferably from 0.2 to 30 g/m$^2$, more preferably from 1 to 15 g/m$^2$. The image-forming layer may contain a crosslinking agent for crosslinking, surfactant for improving coatability and so forth.

Further, a combination of polymer latexes having different I/O values is also preferably used as the binder of the protective layer. The I/O values are obtained by dividing an inorganicity value with an organicity value, both of which values are based on the organic conceptual diagram described in Japanese Patent Application No. 11-6872, paragraphs 0025–0029.

In the present invention, a plasticizer (e.g., benzyl alcohol, 2,2,4-trimethylpentanediol-1,3-monoisobutyrate etc.) described in Japanese Patent Application No. 11-143058, paragraphs 0021–0025 can be added to control the film-forming temperature. Further, a hydrophilic polymer may be added to a polymer binder, and a water-miscible organic solvent may be added to a coating solution as described in Japanese Patent Application No. 11-6872, paragraphs 0027–0028.

First polymer latex introduced with functional groups, and a crosslinking agent and/or second polymer latex having a functional group that can react with the first polymer latex, which are described in Japanese Patent Application No. 10-199626, paragraphs 0023–0041, can also be added to each layer.

The aforementioned functional groups may be carboxyl group, hydroxyl group, isocyanate group, epoxy group, N-methylol group, oxazolinyl group or so forth. The crosslinking agent is selected from epoxy compounds, isocyanate compounds, blocked isocyanate compounds, methylolated compounds, hydroxy compounds, carboxyl compounds, amino compounds, ethylene-imine compounds, aldehyde compounds, halogen compounds and so forth. Specific examples of the crosslinking agent include, as isocyanate compounds, hexamethylene isocyanate, Duranate WB40-80D, WX-1741 (Asahi Chemical Industry Co., Ltd.), Bayhydur 3100 (Sumitomo Bayer Urethane Co., Ltd.), Takenate WD725 (Takeda Chemical Industries, Ltd.), Aquanate 100, 200 (Nippon Polyurethane Industry Co., Ltd.), water dispersion type polyisocyanates mentioned in JP-A-9-160172; as an amino compound, Sumitex Resin M-3 (Sumitomo Chemical Co., Ltd.); as an epoxy compound, Denacol EX-614B (Nagase Chemicals Ltd.); as a halogen compound, 2,4-dichloro-6-hydroxy-1,3,5-triazine sodium salt and so forth.

The total amount of the binders for the image-forming layer is preferably in the range of 0.2–30 g/m$^2$, more preferably 1.0–15 g/m$^2$.

The total amount of the binders for the protective layer is preferably in the range of 0.2–10.0 g/m$^2$, more preferably 0.5–6.0 g/m$^2$.

The total amount of the binders for the back layer is preferably in the range of 0.01–10.0 g/m$^2$, more preferably 0.05–5.0 g/m$^2$.

Each of these layers may be provided as two or more layers. When the image-forming layer consists of two or more layers, it is preferred that polymer latex should be used as a binder for all of the layers. The protective layer is a layer provided on the image-forming layer, and it may consist of two or more layers. In such a case, it is preferred that polymer latex should be used for at least one layer, especially the outermost protective layer. Further, the back layer is a layer provided on an undercoat layer for the back surface of the support, and it may consist of two or more layers. In such a case, it is preferred that polymer latex should be used for at least one layer, especially the outermost back layer.

A lubricant referred to in the present specification means a compound which, when present at the surface of an object, reduces the friction coefficient of the surface compared with that observed when the compound is absent. The type of the lubricant is not particularly limited.

Examples of the lubricant that can be used in the present invention include the compounds described in JP-A-11-84573, paragraphs 0061–0064 and Japanese Patent Application No. 11-106881, paragraphs 0049–0062.

Preferred examples of the lubricant include Cellosol 524 (main component: carnauba wax), Polyron A, 393, H-481 (main component: polyethylene wax), Himicron G-110 (main component: ethylene bisstearic acid amide), Himicron G-270 (main component: stearic acid amide) (all produced by Chukyo Yushi Co., Ltd.), W-1: $C_{16}H_{33}$—O—$SO_3Na$ W-2: $C_{18}H_{37}$—O—$SO_3Na$ and so forth.

The amount of the lubricant used is 0.1–50 weight %, preferably 0.5–30 weight %, of the amount of binder in a layer to which the lubricant is added.

When such a development apparatus as disclosed in Japanese Patent Application Nos. 10-346561 and 11-106881 is used, in which a photothermographic material is transported in a pre-heating section by facing rollers, and the material is transported in a heat development section by driving force of rollers facing the image-forming layer side of the material, while the opposite back surface slides on a smooth surface, ratio of friction coefficients of the outermost surface of the image-forming layer side of the material and the outermost surface of the back layer is 1.5 or more at the heat development temperature. Although the ratio is not particularly limited for its upper limit, it is about 30 or less. The value of $\mu b$ included in the following equation is 1.0 or less, preferably 0.05–0.8. The ratio can be obtained in accordance with the following equation.

Ratio of friction coefficients=coefficient of dynamic friction between roller material of heat development apparatus and surface of image-forming layer side ($\mu e$)/coefficient of dynamic friction between material of smooth surface member of heat development apparatus and back surface ($\mu b$)

In the present invention, the lubricity between the materials of the heat development apparatus and the surface of image-forming layer side and/or the opposite back surface at the heat development temperature can be controlled by adding a lubricant to the outermost layers and adjusting its addition amount.

It is preferred that undercoat layers containing a vinylidene chloride copolymer comprising 70 weight % or more of repetition units of vinylidene chloride monomers should be provided on both surface of the support. Such a vinylidene chloride copolymer is disclosed in JP-A-64-20544, JP-A-1-180537, JP-A-1-209443, JP-A-1-285939, JP-A-1-296243, JP-A-2-24649, JP-A-2-24648, JP-A-2-184844, JP-A-3-109545, JP-A-3-137637, JP-A-3-141346, JP-A-3-141347, JP-A-4-96055, U.S. Pat. No. 4,645,731, JP-A-4-68344, Japanese Patent No. 2,557,641, page 2, right column, line 20 to page 3, right column, line 30, Japanese Patent Application No. 10-221039, paragraphs 0020–0037 and Japanese Patent Application No. 11-106881, paragraphs 0063–0080.

If the vinylidene chloride monomer content is less than 70 weight %, sufficient moisture resistance cannot be obtained, and dimensional change with time after the heat development will become significant. The vinylidene chloride copolymer preferably contains repetition units of carboxyl group-containing vinyl monomers, besides the repetition units of vinylidene chloride monomer. A polymer consisting solely of vinylidene chloride monomers crystallizes, and therefore it becomes difficult to form a uniform film when a moisture resistant layer is coated. Further, carboxyl group-containing vinyl monomers are indispensable for stabilizing the polymer. For these reasons, the repetition units of carboxyl group-containing vinyl monomers are added to the polymer.

The vinylidene chloride copolymer used in the present invention preferably has a molecular weight of 45,000 or less, more preferably 10,000–45,000, as a weight average molecular weight. When the molecular weight becomes large, adhesion between the vinylidene chloride copolymer layer and the support layer composed of polyester or the like tends to be degraded.

The content of the vinylidene chloride copolymer used in the present invention is such an amount that the undercoat layers should have a thickness of 0.3 $\mu$m or more, preferably 0.3 $\mu$m to 4 $\mu$m, as a total thickness of the undercoat layers containing the vinylidene chloride copolymer for one side.

The vinylidene chloride copolymer layer as an undercoat layer is preferably provided as a first undercoat layer, which is directly coated on the support, and usually one vinylidene chloride copolymer layer is provided for each side. However, two or more of layers may be provided as the case may be. When multiple layers consisting of two or more layers are provided, the total amount of the vinylidene chloride copolymer may be within the range of the present invention defined above.

Such an undercoat layer may contain a crosslinking agent, matting agent or the like, in addition to the vinylidene chloride copolymer.

The support may be coated with an undercoat layer comprising SBR, polyester, gelatin or the like as a binder, in addition to the vinylidene chloride copolymer layer, as required. These undercoat layers may have a multilayer structure, and may be provided on one side or both sides of the support. The undercoat layers generally have a thickness (per layer) of 0.01–5 $\mu$m, more preferably 0.05–1 $\mu$m.

For the image recording material of the present invention, various kinds of supports can be used. Typical supports comprise polyester such as polyethylene terephthalate, and polyethylene naphthalate, cellulose nitrate, cellulose ester, polyvinylacetal, syndiotactic polystyrene, polycarbonate, paper support of which both surfaces are coated with polyethylene or the like. Among these, biaxially stretched polyester, especially polyethylene terephthalate (PET), is preferred in view of strength, dimensional stability, chemical resistance and so forth. The support preferably has a thickness of 90–180 $\mu$m as a base thickness except for the undercoat layers.

Preferably used as the support of the image recording material of the present invention is a polyester film, in particular, polyethylene terephthalate film, subjected to a heat treatment in a temperature range of 130–185° C. in order to relax the internal distortion formed in the film during the biaxial stretching so that thermal shrinkage distortion occurring during the heat development should be eliminated. Such films are described in JP-A-10-48772, JP-A-10-10676, JP-A-10-10677, JP-A-11-65025 and Japanese Patent Application No. 9-308898.

After such a heat treatment, the support preferably shows dimensional changes caused by heating at 120° C. for 30 seconds of −0.03% to +0.01% for the machine direction (MD) and 0 to 0.04% for the transverse direction (TD).

The image recording material of the present invention can be subjected to an antistatic treatment using the conductive metal oxides and/or fluorinated surfactants disclosed in JP-A-11-84573, paragraphs 0040-0051 for the purposes of reducing adhesion of dusts, preventing generation of static marks, preventing transportation failure during the automatic transportation process and so forth. As the conductive metal oxides, the conductive acicular tin oxide doped with antimony disclosed in U.S. Pat. No. 5,575,957 and Japanese Patent Application No. 10-41302, paragraphs 0012–0020 and the fibrous tin oxide doped with antimony disclosed in JP-A-4-29134 can be preferably used.

The layer containing a metal oxide should show a surface specific resistance (surface resistivity) of $10^{12}$ O or less, preferably $10^{11}$ O or less, in an atmosphere at 25° C. and 20% of relative humidity. Such a resistivity provides good antistatic property. Although the surface resistivity is not particularly limited as for the lower limit, it is usually about $10^{7}$ O.

The image recording material of the present invention preferably has a Beck's smoothness of 2000 seconds or less, more preferably 10 seconds to 2000 seconds, as for at least one of the outermost surfaces of the image-forming layer side and the opposite side, preferably as for the both sides.

Beck smoothness can be easily determined according to Japanese Industrial Standard (JIS) P8119, "Test Method for Smoothness of Paper and Paperboard by Beck Test Device" and TAPPI Standard Method T479.

Beck's smoothness of the outermost surfaces of the image-forming layer side and the opposite side of the image recording material can be controlled by suitably selecting particle size and amount of matting agent to be contained in the layers on the both surfaces as described in JP-A-11-84573, paragraphs 0052–0059.

In the present invention, water-soluble polymers are preferably used as a thickener for imparting coating property. The polymers may be either naturally occurring polymers or synthetic polymers, and types thereof are not particularly limited. Specifically, there are mentioned naturally occurring polymers such as starches (corn starch, starch etc.), seaweeds (agar, sodium arginate etc.), vegetable adhesive substances (gum arabic etc.), animal proteins (glue, casein, gelatin, egg white etc.) and adhesive fermentation products (pullulan, dextrin etc.), semisynthetic poymers such as semisynthetic starches (soluble starch, carboxyl starch, dextran etc.) and semisynthetic celluloses (viscose, methyl cellulose, ethyl cellulose, carboxymethyl cellulose, hydroxyethyl cellulose, hydroxypropyl cellulose, hydroxypropylmethyl cellulose etc.), synthetic polymers (polyvinyl alcohol, polyacrylamide, polyvinylpyrrolidone, polyethylene glycol, polypropylene glycol, polyvinyl ether, polyethylene-imine, polystyrenesulfonic acid or styrenesulfonic acid copolymer, polyvinylslfanoic acid or vinylslfanoic acid copolymer, polyacrylic acid or acrylic acid copolymer, acrylic acid or acrylic acid copolymer, maleic acid copolymer, maleic acid monoester copolymer, polyacryloyl methylpropanesulfonate or acryloyl methylpropanesulfonate copolymer) and so forth.

Among these, water-soluble polymers preferably used are sodium arginate, gelatin, dextran, dextrin, methylcellulose, carboxymethyl cellulose, hydroxyethyl cellulose, hydroxypropyl cellulose, polyvinyl alcohol, polyacrylamide, polyvinylpyrrolidone, polyethylene glycol, polypropylene glycol, polystyrenesulfonic acid or styrenesulfonic acid copolymer, polyacrylic acid or acrylic acid copolymer, maleic acid monoester copolymer, polyacryloylmethyl propanesulfonate or acryloylmethyl propanesulfonate copolymer, and they are preferably used particularly as a thickener.

Among these, particularly preferred thickeners are gelatin, dextran, methyl cellulose, carboxymethyl cellulose, hydroxyethyl cellulose, polyvinyl alcohol, polyacrylamide, polyvinylpyrrolidone, polystyrenesulfonate or styrenesulfonate copolymer, polyacrylic acid or acrylic acid copolymer, maleic acid monoester copolymer and so forth. These compounds are described in detail in "Shin Suiyosei Polymer no Oyo to Shijo (Applications and Market of Water-soluble Polymers, New Edition)", CMC Shuppan, Inc., Ed. by Shinji Nagatomo, Nov. 4, 1988.

The amount of the water-soluble polymer used as a thickener is not particularly limited so long as viscosity is increased when it is added to a coating solution. Its concentration in the solution is generally 0.01 to 30 weight %, preferably 0.05 to 20 weight %, particularly preferably 0.1 to 10 weight %. Viscosity to be increased by the polymers is preferably 1–200 mPa•s, more preferably 5–100 mPa•s, as increased degree of viscosity compared with the initial viscosity. The viscosity is represented with values measured at 25° C. by using B type rotational viscometer. Upon addition to a coating solution or the like, it is generally desirable that the thickener is added as a solution diluted as far as possible. It is also desirable to perform the addition with sufficient stirring.

Surfactants used in the present invention will be described below. The surfactants used in the present invention are classified into dispersing agents, coating agents, wetting agents, antistatic agents, photographic property controlling agents and so forth depending on the purposes of use thereof, and the purposes can be attained by suitably selecting the surfactants described below and using them. As the surfactants used in the present invention, any of nonionic or ionic (anionic, cationic, betaine) surfactants can be used. Further, fluorinated surfactants can also be preferably used.

Preferred examples of the nonionic surfactant include surfactants having polyoxyethylene, polyoxypropylene, polyoxybutylene, polyglycidyl, sorbitan or the like as the nonionic hydrophilic group. Specifically, there can be mentioned polyoxyethylene alkyl ethers, polyoxyethylene alkyl phenyl ethers, polyoxyethylene/polyoxypropylene glycols, polyhydric alcohol aliphatic acid partial esters, polyoxyethylene polyhydric alcohol aliphatic acid partial esters, polyoxyethylene aliphatic acid esters, polyglycerin aliphatic acid esters, aliphatic acid diethanolamides, triethanolamine aliphatic acid partial esters and so forth.

Examples of anionic surfactants include carboxylic acid salts, sulfuric acid salts, sulfonic acid salts and phosphoric acid salts. Typical examples thereof are aliphatic acid salts, alkylbenzenesulfonates, alkylnaphthalenesulfonates, alkylsulfonates, a-olefin-sulfonates, dialkylsulfosuccinates, a-sulfonated aliphatic acid salts, N-methyl-N-oleyltaurine, petroleum sulfonates, alkylsulfates, sulfated fats and oils, polyoxyethylene alkyl ether sulfates, polyoxyethylene alkyl phenyl ether sulfates, polyoxyethylene styrenylphenyl ether sulfates, alkyl phosphates, polyoxyethylene alkyl ether phosphates, naphthalenesulfonate formaldehyde condensates and so forth.

Examples of the cationic surfactants include amine salts, quaternary ammonium salts, pyridinium salts and so forth, and primary to tertiary amine salts and quaternary ammonium salts (tetraalkylammonium salts, trialkylbenzylammonium salts, alkylpyridinium salts, alkylimidazolium salts etc.) can be mentioned.

Examples of betaine type surfactants include carboxybetaine, sulfobetaine and so forth, and N-trialkyl-N-carboxymethylammonium betaine, N-trialkyl-N-sulfoalkyleneammonium betaine and so forth can be mentioned.

These surfactants are described in Takao Kariyone, "Kaimen Kasseizai no Oyo (Applications of Surfactants", Saiwai Shobo, Sep. 1, 1980). In the present invention, amounts of the preferred surfactants are not particularly limited, and they can be used in an amount providing desired surface activating property. The coating amount of the fluorine-containing surfactants is preferably 0.01–250 mg per 1 $m^2$.

Specific examples of the surfactants are mentioned below. However, the surfactants are not limited to these (—$C_6H_4$— represents phenylene group in the following formulas).

WA-1: $C_{16}H_{33}(OCH_2CH_2)_{10}OH$

WA-2: $C_9H_{19}$—$C_6H_4$—$(OCH_2CH_2)_{12}OH$

WA-3: Sodium dodecylbenzenesulfonate

WA-4: Sodium tri(isopropyl)naphthalenesulfonate

WA-5: Sodium tri(isobutyl)naphthalenesulfonate

WA-6: Sodium dodecylsulfate

WA-7: a-Sulfasuccinic acid di(2-ethylhexyl) ester sodium salt

WA-8: $C_8H_{17}$—$C_6H_4$—$(CH_2CH_2O)_3(CH_2)_2SO_3K$

WA-10: Cetyltrimethylammonium chloride

WA-11: $C_{11}H_{23}CONHCH_2CH_2N^{(+)}(CH_3)_2$—$CH_2COO^{(-)}$

WA-12: $C_8F_{17}SO_2N(C_3H_7)(CH_2CH_2O)_{16}H$

WA-13: $C_8F_{17}SO_2N(C_3H_7)CH_2COOK$

WA-14: $C_8F_{17}SO_3K$

WA-15: $C_8F_{17}SO_2N(C_3H_7)(CH_2CH_2O)_4(CH_2)_4SO_3Na$

WA-16: $C^8F_{17}SO_2N(C_3H_7)(CH_2)_3OCH_2CH_2N^{(+)}(CH_3)_3$—$CH_3.C_6H_4$—$SO_3^{(-)}$

WA-17: $C^8F_{17}SO_2N(C_3H_7)CH_2CH_2CH_2N^{(+)}(CH_3)_2$—$CH_2COO^{(-)}$

In a preferred embodiment of the present invention, an intermediate layer may be provided as required in addition to the image-forming layer and the protective layer. To improve the productivity or the like, it is preferred that these multiple layers should be simultaneously coated as stacked layers by using aqueous systems. While extrusion coating, slide bead coating, curtain coating and so forth can be mentioned as the coating method, the slide bead coating method shown in Japanese Patent Application No. 10-292849, FIG. 1, is particularly preferred.

Silver halide photographic photosensitive materials utilizing gelatin as a main binder are rapidly cooled in a first drying zone, which is provided downstream from a coating die. As a result, the gelatin gels and the coated film is solidified by cooling. The coated film that no longer flows as a result of the solidification by cooling is transferred to a second drying zone, and the solvent in the coating solution is evaporated in this drying zone and subsequent drying zones so that a film is formed. As drying method after the second drying zone, there can be mentioned the air loop method where a support supported by rollers is blown by air jet from a U-shaped duct, the helix method (air floating method) where the support is helically wound around a cylindrical duct and dried during transportation and so forth.

When the layers are formed by using coating solutions comprising polymer latex as a main component of binder, the flow of the coating solution cannot be stopped by rapid cooling. Therefore, the predrying may be insufficient only with the first drying zone. In such a case, if such a drying method as utilized for silver halide photographic photosensitive materials is used, uneven flow or uneven drying may occur, and therefore serious defects are likely to occur on the coated surface.

The preferred drying method for the present invention is such a method as described in Japanese Patent Application No. 10-292849, where the drying is attained in a horizontal drying zone irrespective of the drying zones, i.e., the first or second drying zone, until, as a minimum, the constant rate drying is finished. The transportation of the support during the period immediately after the coating and before the support is introduced into the horizontal drying zone may be performed either horizontally or not horizontally, and the rising angle of the material with respect to the horizontal direction of the coating machine may be within the range of 0–70°. Further, in the horizontal drying zone used in the present invention, the support may be transported at an angle within ±15° with respect to the horizontal direction of the coating machine, and it does not mean exactly horizontal transportation.

The constant rate drying used in the present invention means a drying process in which all entering calorie is consumed for evaporation of solvent at a constant liquid film temperature. Decreasing rate drying means a drying process where the drying rate is reduced by various factors (for example, diffusion of moisture in the material for transfer becomes a rate-limiting factor, evaporation surface is recessed etc.) in an end period of the drying, and imparted calorie is also used for increase of liquid film temperature. The critical moisture content for the transition from the constant rate drying to the decreasing rate drying is 200–300%. When the constant rate drying is finished, the drying has sufficiently progressed so that the flowing should be stopped, and therefore such a drying method as used for silver halide photographic photosensitive materials may also be employable. In the present invention, however, it is preferred that the drying should be performed in a horizontal drying zone until the final drying degree is attained even after the constant rate drying.

As for the drying condition for forming the image-forming layer and/or protective layer, it is preferred that the liquid film surface temperature during the constant rate drying should be higher than minimum film forming temperature (MTF) of polymer latex (MTF is usually higher than glass transition temperature Tg of polymer by 3–5° C.). In many cases, it is usually selected from the range of 25–40° C., because of limitations imposed by production facilities. Further, the dry bulb temperature during the decreasing rate drying is preferably lower than Tg of the support (in the case of PET, usually 80° C. or lower). The liquid film surface temperature referred to in this specification means a solvent liquid film surface temperature of coated liquid film coated on a support, and the dry bulb temperature means a temperature of drying air blow in the drying zone.

If the constant rate drying is performed under a condition that lowers the liquid film surface temperature, the drying is likely to become insufficient. Therefore, the film-forming property of the protective layer is markedly degraded, and it becomes likely that cracks will be generated on the film surface. Further, film strength also becomes weak and thus it becomes likely that there arise serious problems, for example, the film becomes liable to suffer from scratches during transportation in a light exposure apparatus or heat development apparatus.

On the other hand, if the drying is performed under a condition that elevates the liquid film surface temperature, the protective layer mainly consisting of polymer latex rapidly becomes a film, but the under layers including the image-forming layer do not lose flowability, and hence it is likely that unevenness is formed on the surface. Furthermore, if the support (base) is subjected to a temperature higher than its Tg, dimensional stability and resistance to curl tendency tends to be degraded.

While the same is applied to the serial coating, in which an under layer is coated and then an upper layer is coated. As for properties of coating solutions, when an upper layer and a lower layer are coated simultaneously as stacked layers by coating the upper layer before drying of the lower layer, in particular, a coating solution for the image-forming layer and a coating solution for protective layer preferably show a pH difference of 2.5 or less, and a smaller value of this pH difference is more preferred. If the pH difference becomes large, it becomes likely that microscopic aggregations are generated at the interface of the coating solutions and thus it becomes likely that serious defects of surface condition such as coating stripes occur during continuous coating for a long length.

The coating solution for the image-forming layer preferably has a viscosity of 15–100 mPa•S, more preferably 30–70 mPa•S, at 25° C. The coating solution for the protective layer preferably has a viscosity of 5–75 mPa•S, more preferably 20–50 mPa•S, at 25° C. These viscosities are measured by using a B-type viscometer.

The rolling up after the drying is preferably carried out under conditions of a temperature of 20–30° C. and a relative humidity of 45±20%. As for rolled shape, the material may be rolled so that the surface of the image-forming layer side may be toward the outside or inside of the roll according to a shape suitable for subsequent processing. Further, it is also preferred that, when the material is further processed in a rolled shape, the material should be rolled up into a shape of roll in which the sides are reversed compared with the original rolled shape during processing, in order to eliminate the curl generated while the material is in the original rolled shape. Relative humidity of the photosensitive material is preferably controlled to be in the range of 20–55% (measured at 25° C.).

In conventional coating solutions for photographic emulsions, which are viscous solutions containing silver halide and gelatin as a base, air bubbles are dissolved in the solutions and eliminated only by feeding the solutions by pressurization, and air bubbles are scarcely formed even when the solutions are placed under atmospheric pressure again for coating. However, as for the coating solution for the image-forming layer containing dispersion of silver salt of organic acid, polymer latex and so forth preferably used in the present invention, only feeding of it by pressurization is likely to result in insufficient degassing. Therefore, it is preferably fed so that air/liquid interfaces should not be produced, while giving ultrasonic vibration to perform degassing.

In the present invention, the degassing of a coating solution is preferably performed by a method where the coating solution is degassed under reduced pressure before coating, and further the solution is maintained in a pressurized state at a pressure of 1.5 kg/cm$^2$ or more and continuously fed so that air/liquid interfaces should not be formed, while giving ultrasonic vibration to the solution. Specifically, the method disclosed in JP-B-55-6405 (from page 4, line 20 to page 7, line 11) is preferred. As an apparatus for performing such degassing, the apparatus disclosed in Japanese Patent Application No. 10-290003, examples and FIG. 3, is preferably used.

The pressurization condition is preferably 1.5 kg/cm$^2$ or more, more preferably 1.8 kg/cm$^2$ or more. While the pressure is not particularly limited as for its upper limit, it is usually about 5 kg/cm$^2$ or less. Ultrasonic wave given to the solution should have a sound pressure of 0.2 V or more, preferably 0.5–3.0 V. Although a higher sound pressure is generally preferred, an unduly high sound pressure provides high temperature portions due to cavitation, which may causes fogging. While frequency of the ultrasonic wave is not particularly limited, it is usually 10 kHz or higher, preferably 20 kHz to 200 kHz. The degassing under reduced pressure means a process where a coating solution is placed in a sealed tank (usually a tank in which the solution is prepared or stored) under reduced pressure to increase diameters of air bubbles in the coating solution so that degassing should be attained by buoyancy gained by the air bubbles. The reduced pressure condition for the degassing under reduced pressure is −200 mmHg or a pressure condition lower than that, preferably −250 mmHg or a pressure condition lower than that. Although the lower limit of the pressure condition is not particularly limited, it is usually about −800 mmHg or higher. Time under the reduced pressure is 30 minutes or more, preferably 45 minutes or more, and its upper limit is not particularly limited.

In the present invention, the image-forming layer, protective layer for the image-forming layer, undercoat layer and back layer may contain a dye in order to prevent halation and so forth as disclosed in JP-A-11-84573, paragraphs 0204–0208 and Japanese Patent Application No. 11-106881, paragraphs 0240–0241.

Various dyes and pigments can be used for the image-forming layer for improvement of color tone and prevention of irradiation. While arbitrary dyes and pigments may be used for the image-forming layer, the compounds disclosed in JP-A-11-119374, paragraphs 0297, for example, can be used. These dyes may be added in any form such as solution, emulsion, solid microparticle dispersion and macromolecule mordant mordanted with the dyes. Although the amount of these compounds is determined by the desired absorption, they are preferably used in an amount of $1\times10^{-6}$ g to 1 g per 1 m$^2$, in general.

When an antihalation dye is used in the present invention, the dye may be any compound so long as it shows intended absorption in a desired range and sufficiently low absorption in the visible region after development, and provides a preferred absorption spectrum pattern of the back layer. For example, the compounds disclosed in JP-A-11-119374, paragraph 0300 can be used. There can also be used a method of reducing density obtained with a dye by thermal decoloration as disclosed in Belgian Patent No. 733,706, a method of reducing the density by decoloration utilizing light irradiation as disclosed in JP-A-54-17833 and so forth.

When the thermally processed image recording material of the present invention after heat development is used as a mask for the production of printing plate from a PS plate, the thermally processed image recording material after heat development carries information for setting up light exposure conditions of platemaking machine for PS plates or information for setting up platemaking conditions including transportation conditions of mask originals and PS plates as image information. Therefore, in order to read such information, densities (amounts) of the aforementioned irradiation dye, halation dye and filter dye are limited. Because the information is read by LED or laser, Dmin (minimum density) in a wavelength region of the sensor must be low, i.e., the absorbance must be 0.3 or less. For example, a platemaking machine S-FNRIII produced by Fuji Photo Film Co., Ltd. uses a light source having a wavelength of 670 nm for a detector for detecting resister marks and a bar code reader. Further, platemaking machines of APML series produced by Shimizu Seisaku Co., Ltd. utilize a light source at 670 nm as a bar code reader. That is, if Dmin (minimum density) around 670 nm is high, the information on the film cannot be correctly detected, and thus operation errors such as transportation failure, light exposure failure and so forth are caused in platemaking machines. Therefore, in order to read information with a light source of 670 nm, Dmin around 670 nm must be low and the absorbance at 660–680 nm after the heat development must be 0.3 or less, more preferably 0.25 or less. Although the absorbance is not particularly limited as for its lower limit, it is usually about 0.10.

In the present invention, as the exposure apparatus used for the imagewise light exposure, any apparatus may be used so long as it is an exposure apparatus enabling light exposure with an exposure time of $10^{-7}$ second or shorter. However, a light exposure apparatus utilizing a laser diode (LD) or a light emitting diode (LED) as a light source is preferably used in general. In particular, LD is more preferred in view of high output and high resolution. Any of these light sources may be used so long as they can emit a light of electromagnetic wave spectrum of desired wavelength range. For example, as for LD, dye lasers, gas lasers, solid state lasers, semiconductor lasers and so forth can be used. Semiconductor lasers are particularly preferred, and specific examples thereof include those utilizing $In_{1-x}Ga_xP$ (about 700 nm), $GaAs_{1-x}P_x$, (610–900 nm), $Ga_{1-x}Al_xAs$ (690–900 nm), InGaAsP (1100–1670 nm), AlGaAsSb (1250–1400 nm) and so forth. Irradiation of light to the color photosensitive material of the present invention may also be performed by using, besides the aforementioned semiconductor lasers, a YAG laser in which Nb:YAG crystals are excited by $GaAs_xP_{1-x}$ light emitting diode. The use of light selected from the semiconductor laser light beams at wavelengths of 670, 680, 750, 780, 810, 830 and 880 nm is preferred.

In the present invention, the second harmonics generating element (SHG element) means an element that converts wavelength of a laser ray to ½ by utilizing non-linear optical effect. Examples thereof include, for example, those utilizing CD*A or KD*P as non-linear optical crystals (see Laser Handbook, edited by the Laser Society of Japan, published on Dec. 15, 1982, pp.122–139). Further, an $LiNbO_3$ photoconductive waveguide element comprising $LiNbO_3$ crystals in which $Li^+$ is ion-exchanged with $H^+$ to form waveguide may also be used (see Nikkei Electronics, published on Jul. 14, 1986, No. 399, pp. 89–90). The output device described in Japanese Patent Application No. 63-226552 can be used for the present invention.

The light exposure is performed with overlapped light beams of light sources. The term "overlapped" means that a vertical scanning pitch width is smaller than the diameter of the beams. For example, the overlap can be quantitatively expressed as FWHM/vertical-scanning pitch width (overlap coefficient), where the beam diameter is represented as a half width of beam strength (FWHM). In the present invention, it is preferred that this overlap coefficient is 0.2 or more. The energy density of the exposure is preferably several to several hundreds of microjoules ($\mu$J) per $cm^2$, more preferably several to several tens of microjoules per $cm^2$.

The scanning method of the light source of the light exposure apparatus used in the present invention is not particularly limited, and the cylinder external surface scanning method, cylinder internal surface scanning method, flat surface scanning method and so forth can be used. Although the channel of light source may be either single channel or multichannel, a multichannel is preferably used for the cylinder external surface scanning method.

The image recording material of the present invention shows low haze upon the light exposure, and therefore it is likely to generate interference fringes. As techniques for preventing such interference fringes, there are known a technique of obliquely irradiating a photothermographic material with a laser light as disclosed in JP-A-5-113548, a technique of utilizing a multimode laser as disclosed in WO95/31754 and so forth, and these techniques are preferably used.

Although any method may be used for the heat development process of the image-forming method utilizing the image recording material of the present invention, the development is usually performed by heating a thermally processed image recording material exposed imagewise. As preferred embodiments of heat development apparatus to be used, there are heat development apparatuses in which a thermally processed image recording material is brought into contact with a heat source such as heat roller or heat drum as disclosed in JP-B-5-56499, JP-A-9-292695, JP-A-9-297385 and WO95/30934, and heat development apparatuses of non-contact type as disclosed in JP-A-7-13294, WO97/28489, WO97/28488 and WO97/28487. Particularly preferred embodiments are the heat development apparatuses of non-contact type. The temperature for the development is preferably 80–250° C., more preferably 100–140° C. The development time is preferably 1–180 seconds, more preferably 5–90 seconds. The line speed is preferably 140 cm/minute or less.

As a method for preventing uneven development due to dimensional change of the thermally processed image recording material during the heat development, it is effective to employ a method for forming images wherein the material is heated at a temperature of 80° C. or higher but lower than 115° C. for 5 seconds or more so as not to develop images, and then subjected to heat development at 110–140° C. to form images (so-called multi-step heating method).

Since the thermally processed image recording material of the present invention is subjected to a high temperature of 110° C. or higher during the heat development, a part of the components contained in the material or a part of decomposition products produced by the heat development are volatilized. It is known that these volatilized components exert various bad influences, for example, they may cause uneven development, erode structural members of development apparatuses, deposit at low temperature portions as dusts to cause deformation of image surface, adhere to image surface to cause scumming and so forth. As a method for eliminating these influences, it is known to provide a filter on the heat development apparatus, or optimally control air flows in the heat development apparatus. These methods may be effectively used in combination.

WO95/30933, WO97/21150 and International Patent Publication in Japanese (Kohyo) No. 10-500496 disclose use of a filter cartridge containing binding absorption particles and having a first vent for introducing volatilized components and a second vent for discharging them in heating apparatuses for heating thermally processed image recording material by contact. Further, WO96/12213 and International Patent Publication in Japanese (Kohyo) No. 10-507403 disclose use of a filter consisting of a combination of heat conductive condensation collector and a gas-absorptive microparticle filter. These can be preferably used in the present invention.

Further, U.S. Pat. No. 4,518,845 and JP-B-3-54331 disclose structures comprising means for eliminating vapor from a thermally processed image recording material, pressing means for pressing the thermally processed image recording material to a heat-conductive member and means for heating the heat-conductive member. Further, WO98/27458 discloses elimination of components volatilized from a thermally processed image recording material and increasing fog from a surface of the thermally processed image recording material. These techniques are also preferably used for the present invention.

An example of the structure of heat development apparatus used for the heat development of the thermally processed image recording material of the present invention is shown in FIG. 1. FIG. 1 depicts a side view of a heat development apparatus. The heat development apparatus shown in FIG. 1 comprises carrying-in roller pairs 11 (upper rollers are silicone rubber rollers, and lower rollers are aluminum heating rollers), which carry a thermally processed image recording material 10 into the heating section while making the material in a flat shape and preheating it, and carrying-out roller pairs 12, which carry out the thermally processed image recording material 10 after heat development from the heating section while maintaining the material to be in a flat shape. The thermally processed image recording material 10 is heat-developed while it is conveyed by the carrying-in roller pairs 11 and then by the carrying-out roller pairs 12. Conveying means for carrying the thermally processed image recording material 10 under the heat development is provided with multiple rollers 13 so that they should be contacted with the surface of the image-forming layer side, and a flat surface 14 adhered with non-woven fabric (composed of, for example, aromatic polyamide, Teflon etc.) or the like is provided on the opposite side so that it should be contacted with the back surface. The thermally processed image recording material 10 is conveyed by driving force of the multiple rollers 13 contacted with the image-forming layer side, while the back surface slides on the flat surface 14 Heaters 15 are provided over the rollers 13 and under the flat surface 14 so that the thermally processed image recording material 10 should be heated from the both sides. Examples of the heating means include panel heaters and so forth. While clearance between the rollers 13 and the flat surface 14 may vary depending on the material of the flat surface member, it is suitably adjusted to a clearance that allows the conveyance of the thermally processed image recording material 10. The clearance is preferably 0–1 mm.

The materials of the surfaces of the rollers 13 and the member of the flat surface 14 may be composed of any materials so long as they have heat resistance and they should not cause any troubles in the conveyance of the thermally processed image recording material 10. However, the material of the roller surface is preferably composed of silicone rubber, and the member of the flat surface is preferably composed of non-woven fabric made of aromatic polyamide or Teflon (PTFE). The heating means preferably comprises multiple heaters so that temperature of each heater can be adjusted freely.

The heating section is constituted by a preheating section A comprising the carrying-in roller pairs 11 and a heat development section B comprising the heaters 15. Temperature of the preheating section A locating upstream from the heat development section B is preferably controlled to be lower than the heat development temperature (for example, lower by about 10–30° C.), and temperature and heat development time are desirably adjusted so that they should be sufficient for evaporating moisture contained in the thermally processed image recording material 10. The temperature is also adjusted to be higher than the glass transition temperature (Tg) of the support of the thermally processed image recording material 10 so that uneven development should be prevented. Temperature distribution of the preheating section and the heat development section is preferably ±1° C. or less, more preferably ±0.5° C. or less.

Moreover, guide panels 16 are provided downstream from the heat development section B, and they constitute a gradual cooling section C together with the carrying-out roller pairs 12.

The guide panels 16 are preferably composed of a material of low heat conductivity, and it is preferred that the cooling is performed gradually so as not to cause deformation of the thermally processed image recording material 10. The cooling rate is preferably 0.5–10° C./second.

The heat development apparatus was explained with reference to the example shown in the drawing. However, the apparatus is not limited to the example. For example, the heat development apparatus used for the present invention may have a variety of structures such as one disclosed in JP-A-7-13294. For the multi-step heating method, which is preferably used for the present invention, the image recording material may be successively heated at different temperatures in such an apparatus as mentioned above, which is provided with two or more heat sources at different temperatures.

EXAMPLES

The present invention will be specifically explained with reference to following Examples. Materials, use amounts, ratios, processing contents, manipulations and the like shown in the following examples can be optionally changed so long as such change does not depart from the spirit of the present invention. Therefore, the scope of the present invention is not limited to the following examples.

Example 1

The structures of the compounds used in Example 1 are shown below.

Sensitizing Dye A

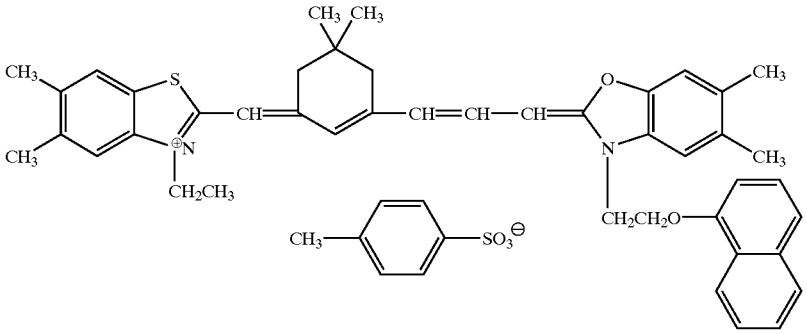

Compound A

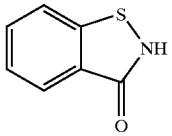

Compound B

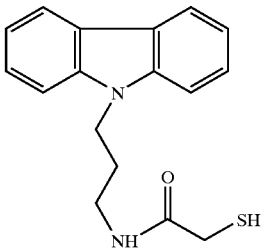

-continued

Ultrahigh contrast agent B

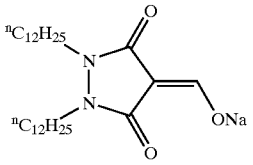

Compound Z

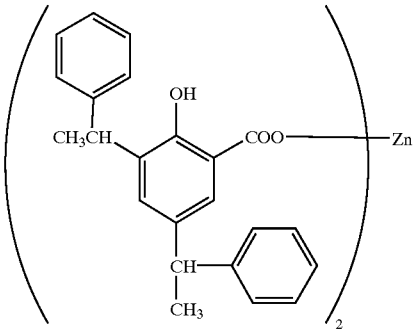

Dye A

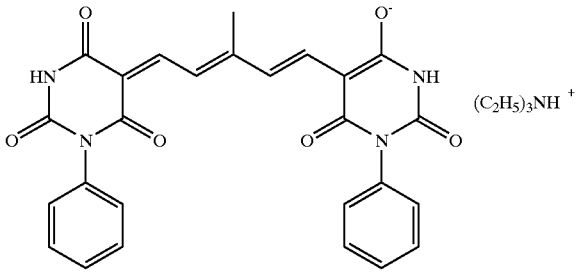

Compound C

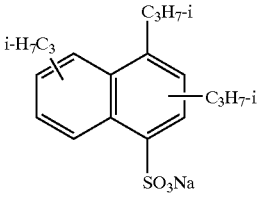

Compound D

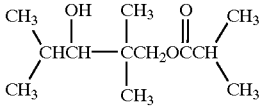

Compound E

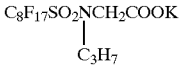

Compound F

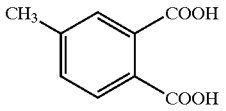

Compound S

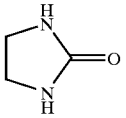

1. Preparation of silver halide emulsion (Emulsion A)

In an amount of 11 g of alkali-treated gelatin (calcium content of 2700 ppm or less), 30 mg of potassium bromide and 10 mg of sodium benzenesulfonate were dissolved in 700 ml of water, and the solution was adjusted to pH 5.0 at a temperature of 40° C., and added with 159 mL of an aqueous solution containing 18.6 g of silver nitrate and an aqueous solution containing 1 mole/liter of potassium bromide, $5\times10^{-6}$ mole/liter of $(NH_4)_2RhCl_5$ $(H_2O)$ and $2\times10^{-5}$ mole/liter of $K_3IrCl_6$ by the control double jet method over a period of 6 minutes and 30 seconds, while the pAg was kept at 7.7. Then, the solution was added with 476 mL of an aqueous solution containing 55.5 g of silver nitrate and an aqueous halide salt solution containing 1 mole/liter of potassium bromide and $2\times10^{-5}$ mole/liter of $K_3IrCl_6$ by the control double jet method over a period of 28 minutes and 30 seconds, while the pAg was kept at 7.7. Thereafter, by lowering the pH to cause aggregation and precipitation to attain a desalting treatment. The mixture was added with 0.17 g of Compound A and 51.1 g of low molecular weight gelatin having an average molecular weight of 15,000 (calcium content: 20 ppm or less), and the pH and pAg of the mixture were adjusted to 5.9 and 8.0, respectively. The obtained grains were cubic grains having a mean grain size of 0.08 μm, a variation coefficient of 9% for projected area and a [100] face ratio of 90%.

The silver halide grains obtained as described above were warmed to a temperature of 60° C., added with 76 μmoles of sodium benzenesulfonate per mole of silver, and after 3 minutes, added with 71 μmoles of triethylthiourea. Then, the mixture was ripened for 100 minutes, and added with $5\times10^{-4}$ mole of 4-hydroxy-6-methyl-1,3,3a,7-tetrazaindene, and the temperature of the mixture was lowered to 40° C.

Thereafter, while the mixture was kept at a temperature of 40° C., the mixture was added with $12.8\times10^{-4}$ mole of Sensitizing dye A and $6.4\times10^{-3}$ mole of Compound B per mole of silver halide with stirring. After 20 minutes, the mixture was quenched to 30° C. to finish the preparation of Silver halide emulsion A.

2. Preparation of organic acid silver salt dispersion (Organic acid silver salt A)

In an amount of 87.6 kg of behenic acid (Edenor C22-85R, trade name, manufactured by Henkel Co.), 423 L of distilled water, 49.2 L of a 5 mol/L aqueous solution of NaOH and 120 L of tert-butanol were mixed and allowed to react with stirring at 75° C. for one hour to obtain a solution of sodium behenate. Separately, 206.2 L of an aqueous solution containing 40.4 kg of silver nitrate was prepared and kept at 10° C. A mixture of 635 L of distilled water and 30 L of tert-butanol contained in a reaction vessel kept at 30° C. was added with the whole amount of the aforementioned sodium behenate solution and the whole amount of the aqueous silver nitrate solution at constant flow rates over the periods of 62 minutes and 10 seconds, and 60 minutes, respectively. In this case, they were added in such a manner that only the aqueous silver nitrate solution was added for 7 minutes and 20 seconds after starting the addition of the aqueous silver nitrate solution, and for 9 minutes 30 seconds after finishing the addition of the aqueous silver nitrate solution, only the sodium behenate solution should be added. In this operation, the temperature in the reaction vessel was kept at 30° C. so that the liquid temperature should not be raised. The piping of the addition system for the sodium behenate solution was warmed by steam trace and the steam amount was controlled such that the liquid temperature at the outlet orifice of the addition nozzle end should be 75° C. The piping of the addition system for the aqueous silver nitrate solution was maintained by circulating cold water outside a double pipe. The addition position of the sodium behenate solution and the addition position of the aqueous silver nitrate solution were arranged symmetrically with respect to the stirring axis as the center, and the positions are controlled at heights for not contacting with the reaction mixture.

After finishing the addition of the sodium behenate solution, the mixture was left with stirring for 20 minutes at the same temperature and then the temperature was decreased to 25° C. Thereafter, the solid content was recovered by a suction filtration and washed with water until electric conductivity of the filtrate became 30 μS/cm. The solid content obtained as described above was stored as a wet cake without being dried.

When the shape of the obtained silver behenate grains was evaluated by an electron microscopic photography, the grains were scaly crystals having a mean diameter of 0.52 μm for projected area, mean grain thickness of 0.14 μm and variation coefficient of 15% for mean diameter as spheres.

Then, a dispersion of silver behenate was prepared as follows. To the wet cake corresponding to 100 g of the dry solid content was added with 7.4 g of polyvinyl alcohol (PVA-217, trade name, average polymerization degree: about 1700) and water to make the total amount 385 g, and the mixture was pre-dispersed by a homomixer. Then, the pre-dispersed stock dispersion was treated three times by using a dispersing machine (Microfluidizer-M-110S-EH; trade name, manufactured by Microfluidex International Corporation, using G10Z interaction chamber) with a pressure controlled to be 1750 kg/cm$^2$ to obtain a silver behenate dispersion. During the cooling operation, a desired dispersion temperature was achieved by providing coiled heat exchangers fixed before and after the interaction chamber and controlling the temperature of the refrigerant.

The silver behenate grains contained in the silver behenate dispersion obtained as described above were grains having a volume weight mean diameter of 0.52 μm and coefficient of variation of 15%. The measurement of the grain size was carried out by using Master Sizer X manufactured by Malvern Instruments Ltd. When the grains were evaluated by an electron microscopic photography, the ratio of the long side to the short side was 1.5, the grain thickness was 0.14 μm and a mean aspect ratio (ratio of circular diameter of projected area of grain and grain thickness) was 5.1.

3. Preparation of solid microparticle dispersion of reducing agent: 1,1-bis(2-hydroxy-3,5-dimethylphenyl)-3,5,5-trimethylhexane In an amount of 25 g of 1,1-bis(2-hydroxy-3,5-dimethylphenyl)-3,5,5-trimethylhexane was added with 25 g of a 20 weight % aqueous solution of MP polymer (MP-203, manufactured by Kuraray Co., Ltd.), 0.1 g of Safinol 104E manufactured by Nisshin Kagaku K. K., 2 g of methanol and 48 mL of water, and the mixture was stirred sufficiently to form slurry, which was then left for 3 hours. Then, 360 g of 1 mm zirconia beads were placed in a vessel together with the slurry and the slurry was dispersed by a dispersing machine (1/4G Sand Grinder Mill; manufactured by Imex Co.) for 3 hours to prepare a dispersion of solid microparticles of the reducing agent. As for the particle sizes, 80% of the particles had a particle size of 0.3 μm to 1.0 μm.

4. Preparation of solid microparticle dispersion of compound of Formula (1)

In an amount of 30 g of each of the compounds of Formula (1) shown in Tables 1 was added with 4 g of MP polymer (MP-203 manufactured by Kuraray Co., Ltd.), 0.25 g of Compound C and 66 g of water and the mixture was stirred sufficiently to form slurry. Thereafter, 200 g of 0.5 mm zirconia silicate beads were placed in a vessel together with the slurry and the slurry was dispersed by a dispersing machine (1/16 G Sand Grinder Mill; manufactured by Imex Co.) for 5 hours to prepare a solid microparticle dispersion. In the particles, 80 weight % of the particles had a diameter of 0.3 μm to 1.0 μm. Each of Comparative Compounds R-1 to R-3 was also dispersed in the same manner as described above.

5. Preparation of solid microparticle dispersion of Ultrahigh contrast agent B

In an amount of 10 g of Ultrahigh contrast agent B was added with 2.5 g of polyvinyl alcohol (PVA-217, manufactured by Kuraray Co., Ltd.) and 87.5 g of water and the mixture was stirred sufficiently to form slurry, which was then left for 3 hour. Thereafter, 240 g of 0.5 mm zirconia beads were placed in a vessel together with the slurry and the slurry was dispersed by a dispersing machine (¼ G Sand Grinder Mill; manufactured by Imex Co.) for 10 hours to prepare a solid microparticle dispersion. In the particles, 80 weight % of the particles had a size of 0.1 μm to 1.0 μm, and the mean particle size was 0.5 μm.

6. Preparation of solid microparticle dispersion of Compound Z

In an amount of 30 g of Compound Z was added with 3 g of MP polymer (MP-203, manufactured by Kuraray Co., Ltd.) and 87 mL of water, and the mixture was stirred sufficiently to form slurry, which was then left for 3 hours. Thereafter, by following the same procedure as the preparation of the aforementioned solid microparticle dispersion of the reducing agent, a solid microparticle dispersion of Compound Z was prepared. In the particles, 80 weight % of the particles had a size of 0.3 μm to 1.0 μm.

7. Preparation of coating solution for emulsion layer

To the organic acid silver salt microcrystal dispersion prepared above were added with the following binder, materials, Silver halide emulsion A and water in the indicated amounts per 1 mole of silver in the organic acid silver salt dispersion to provide a coating solution for emulsion layer.

| | |
|---|---|
| Binder; Laxster 3307B (made by DAINIPPON INK AND CHEMICALS, INC., SBR latex, glass transition temperature: 17° C.) | 500 g as solid content |
| 1,1-Bis(2-hydroxy-3,5-dimethylphenyl-3,5,5-trimethylhexane | 149 g as solid content |
| Compound of Formula (1) | Type and amount (mole) shown in Table 1 |
| Ultrahigh contrast agent B | 15 g as solid content |
| Sodium ethylthiosulfonate | 0.15 g |
| 4-Methylbenzotriazole | 1.04 g |
| Polyvinyl alcohol (PVA-235, made by Kuraray Co., Ltd.) | 10.8 g |
| 6-Isopropylphthalzine | 15.0 g |
| Sodium dihydrogen-orthophsophsate dihydrate | 0.37 g |

-continued

| | |
|---|---|
| Compound Z | 9.7 g as solid content |
| Dye A | Amount giving an optical density of 0.3 at 783 nm (about 0.37 g) |
| Silver halide emulsion A | 0.06 mole as Ag |

8. Preparation of coating solution for lower protective layer of emulsion layer surface In an amount of 956 g of a polymer latex solution of methyl methacrylate/styrene/2-ethylhexyl acrylate/2-hydroxyethyl methacrylate/acrylic acid copolymer=58.9/8.6/25.4/5.1/2 (weight %) having a particle size of 120 nm (glass transition temperature as copolymer: 57° C., solid content concentration: 21.5 weight %, containing Compound D as film-forming aid in an amount of 15 weight % relative to the solid content of the latex) was added with water, and then added with 1.62 g of Compound E, 3.15 g of Compound S, 1.98 g of a matting agent (polystyrene particles, mean particle size: 7 μm), 23.6 g of polyvinyl alcohol (PVA-235, manufactured by Kuraray Co., Ltd.) and water to prepare a coating solution.

9. Preparation of coating solution for upper protective layer of emulsion layer surface In an amount of 630 g of a polymer latex solution of methyl methacrylate/styrene/2-ethylhexyl acrylate/2-hydroxyethyl methacrylate/acrylic acid copolymer=58.9/8.6/25.4/5.1/2 (weight %) having particle diameter of 70 nm (glass transition temperature as copolymer: 54° C., solid content: 21.5 weight %, containing Compound D as a film-forming aid in an amount of 15 weight % as to solid content of the latex) was added with $H_2O$, 6.30 g of 30 weight % solution of carnauba wax (Cellosol 524, Chukyo Yushi Co., Ltd.), 0.72 g of Compound E, 7.95 g of Compound F, 0.90 g of Compound S, 1.18 g of a matting agent (polystyrene particles, mean diameter: 7 μm) and 8.30 g of polyvinyl alcohol (PVA-235, Kuraray Co., Ltd.) and further added with $H_2O$ to form a coating solution.

10. Preparation of PET support having back layer/undercoat layer (1) Support

Using terephthalic acid and ethylene glycol, PET having an intrinsic viscosity IV of 0.66 (measured in phenol/tetrachloroethane=6/4 (weight ratio) at 25° C.) was obtained in a conventional manner. The PET was pelletized, and the pellets were dried at 130° C. for 4 hours, melted at 300° C., extruded from a T-die, and quenched to prepare an unstretched film having such a thickness that the film thickness after thermal fixation should become 120 μm.

The film was stretched along the longitudinal direction by 3.3 times using rollers having different peripheral speeds and then stretched along the transverse direction by 4.5 times using a tenter. In this operation, the temperatures were 110° C. and 130° C., respectively. Thereafter, the film was subjected to thermal fixation at 240° C. for 20 seconds and relaxed by 4% along the transverse direction at the same temperature. Then, after chucks of the tenter were released, the both edges of the film were knurled, and the film was rolled up at 4.8 kg/cm$^2$ to provide a roll of the film having a width of 2.4 m, length of 3500 m and thickness of 120 μm.

(2) Undercoat layer (a):

| | |
|---|---|
| Polymer latex (1) (core shell type latex comprising 90 weight % of core and 10 weight % of shell, core: vinylidene chloride/methyl acrylate/methyl methacrylate/acrylonitrile/acrylic acid = 93/3/3/0.9/0.1 (weight %), shell: vinylidene chloride/methyl acrylate/methyl methacrylate/acrylonitrile/acrylic acid = 88/3/3/3/3 (weight %), weight average molecular weight; 38000) | 3.0 g/m$^2$ as solid content |
| 2,4-Dichloro-6-hydroxy-s-triazine | 23 mg/m$^2$ |
| Matting agent (polystyrene, mean diameter; 2.4 μm) | 1.5 mg/m$^2$ |
| (3) Undercoat layer (b) | 50 mg/m$^2$ |
| Deionized gelatin ($Ca^{2+}$ content: 0.6 ppm, jelly strength: 230 g) | |
| (4) Electroconductive layer | 96 mg/m$^2$ |
| Julimer ET-410 (Nihon Junyaku Co., Ltd.) | |
| Alkali-treated gelatin (molecular weight: about 10000, $Ca^{2+}$ content: 30 ppm) | 42 mg/m$^2$ |
| Deionized gelatin ($Ca^{2+}$ content: 0.6 ppm) | 8 mg/m$^2$ |
| Compound A | 0.2 mg/m$^2$ |
| Polyoxyethylene phenyl ether | 10 mg/m$^2$ |
| Sumitex Resin M-3 (water-soluble melamine resin, Sumitomo Chemical Co., Ltd.) | 18 mg/m$^2$ |
| Dye A | Amount giving optical density of 1.2 at 783 nm |
| $SnO_2$/Sb (weight ratio: 9/1, acicular grains, long axis/short axis = 20–30, Ishihara Sangyo Kaisha, Ltd.) | 160 mg/m$^2$ |
| Matting agent (Polymethyl methacrylate, mean particle size: 5 μm) | 7 mg/m$^2$ |

-continued

| | |
|---|---|
| (5) Protective layer | 1000 mg/m$^2$ |
| Polymer latex (2) (copolymer of methyl methacrylate/styrene/2-ethylhexyl acrylate/2-hydroxyethyl methacrylate/acrylic acid = 59/9/26/5/1 (weight %)) | as solid content |
| Polystyrenesulfonate (molecular weight: 1000–5000) | 2.6 mg/m$^2$ |
| Cellosol 524 (Chukyo Yushi Co., Ltd.) | 25 mg/m$^2$ |
| Sumitex Resin M-3 (water-soluble melamine compound, Sumitomo Chemical Co., Ltd.) | 218 mg/m$^2$ |

(6) Preparation of PET support with back layer and undercoat layer

Undercoat layer (a) and Undercoat layer (b) were applied successively on both sides of the support (base), and each dried at 180° C. for 4 minutes. Then, an electroconductive layer and a protective layer are successively applied to one side provided with Undercoat layer (a) and Undercoat layer (b), and each dried at 180° C. for 4 minutes to prepare a PET support having back layers and undercoat layers. The dry thickness of Undercoat layer (a) was 2.0 $\mu$m.

(7) Heat treatment during transportation (7-1) Heat treatment

The PET support with backing layers and undercoat layers prepared as described above was introduced into a heat treatment zone having a total length of 200 m set at 160° C., and transported at a tension of 3 kg/cm$^2$ and a transportation speed of 20 m/minute.

(7-2) Post-heat treatment

Following the aforementioned heat treatment, the support was passed through a zone at 40° C. for 15 seconds for post-heat treatment, and rolled up. The rolling up tension for this operation was 10 kg/cm$^2$.

11. Preparation of thermally processed image recording material

On the undercoat layers of the aforementioned PET support coated with Undercoat layer (a) and Undercoat layer (b), the coating solution for emulsion layer was coated so that the coated silver amount should become 1.6 g/m$^2$. Further, the coating solution for lower protective layer for emulsion surface was coated on the emulsion layer simultaneously with the coating solution for emulsion layer as stacked layers, so that the coated solid content of the polymer latex should be 1.31 g/m$^2$. Then, the coating solution for upper protective layer for emulsion surface was coated on the coated layer, so that the coated solid content of the polymer latex should be 3.02 g/m$^2$ to obtain a thermally processed image recording material. The obtained thermally processed image recording material showed a film surface pH of 4.9 and Beck's smoothness of 660 seconds on the image-forming layer side. As for the opposite surface, the film surface pH was 5.9 and the Beck's smoothness was 560 seconds.

12. Evaluation of photographic performance

Light Exposure

The obtained thermally processed image recording material was light exposed for $2\times10^{-8}$ seconds by using a laser light-exposure apparatus of single channel cylindrical inner surface type provided with a semiconductor laser with a beam diameter (½ of FWHM of beam intensity) of 12.56 $\mu$m, laser output of 50 mW and output wavelength of 783 nm. The exposure time was adjusted by controlling the mirror revolution number, and exposure was adjusted by changing output. The overlap coefficient of the light exposure was 0.449.

Heat Development

Each light-exposed thermally processed image recording material was heat-developed by using such a heat development apparatus as shown in FIG. 1. The roller surface material of the heat development section was composed of silicone rubber, and the flat surface consisted of Teflon non-woven fabric. The heat development was performed at a transportation linear speed of 20 mm/second and a temperature of 90–110° C. for 15 seconds in the preheating section (driving units of the preheating section and the heat development section were independent from each other, and speed difference as to the heat development section was adjusted to −0.5% to −1%), and 120° C. for 20 seconds in the heat development section, and for 15 seconds in the gradual cooling section. The temperature precision as for the transverse direction was ±1° C.

(Evaluation of Photographic Performance)

The evaluation of the image obtained was performed by using a Macbeth TD904 densitometer (visible density). The measurement results were evaluated as Dmin, sensitivity (evaluated by a relative value of a reciprocal of a ratio of exposure amount giving a density higher than Dmin by 1.0, and the sensitivity of the thermally processed image recording material of Experiment No. 1 shown in Table 1 below was defined as 100), Dmax, and contrast (fresh photographic properties). The contrast was expressed by a gradient of a straight line connecting the points at the densities 0.3 and 1.5, which were obtained by subtracting the value for Dmin, with the abscissa being a logarithm of the exposure amount.

As for the evaluation of image storability, Image storability 1 indicates the change of the photographic properties after storing the thermally processed image recording materials after heat development in the dark for 24 hours at a temperature of 60° C. and relative humidity of 50%, and Image storability 2 indicates the change of the photographic properties after storing them for 24 hours under the light irradiation of 10,000 luces at a temperature of 40° C. and relative humidity of 50%.

The results are shown in Table 1.

TABLE 1

| Experiment No. | Compound of Formula (1) | Added amount (mol/mol-Ag) | Fresh photographic property | | | | Image storability-1 (stored in dark, 60° C., 50% RH) | | Image storability-2 (stored in light, 40° C., 50% RH) | | Note |
|---|---|---|---|---|---|---|---|---|---|---|---|
| | | | Dmin | Sensitivity | Contrast | Dmax | Dmin | Dmax | Dmin | Dmax | |
| 1 | C-3 | $1 \times 10^{-2}$ | 0.13 | 100 | 19.0 | 4.1 | 0.15 | 4.1 | 0.15 | 4.1 | Invention |
| 2 | C-6 | $1 \times 10^{-2}$ | 0.12 | 98 | 19.0 | 4.0 | 0.14 | 4.0 | 0.14 | 4.0 | Invention |
| 3 | C-27 | $1 \times 10^{-2}$ | 0.18 | 115 | 21.0 | 4.5 | 0.20 | 4.5 | 0.20 | 4.4 | Invention |
| 4 | R-1 | $1 \times 10^{-2}$ | 0.11 | — | 2.5 | 2.5 | 0.16 | 2.5 | 0.15 | 2.5 | Comparative |
| 5 | R-2 | $1 \times 10^{-2}$ | 0.10 | — | 2.2 | 2.1 | 0.14 | 1.9 | 0.25 | 2.1 | Comparative |
| 6 | R-3 | $1 \times 10^{-2}$ | 2.1 | — | — | 3.9 | 2.8 | 4.1 | 2.8 | 4.1 | Comparative |
| 7 | None | — | 0.21 | 104 | 19.0 | 3.9 | 0.36 | 3.9 | 0.30 | 3.8 | Invention |

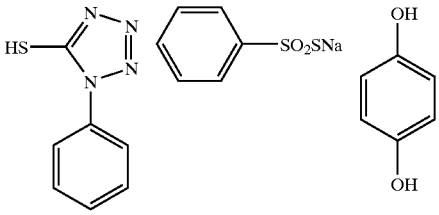

R-1 R-2 R-3

As seen from the results shown in Table 1, decreases of contrast and Dmax observed in Samples 1 and 2 according to the present invention were lower than those observed in Comparative Examples 4 and 5. Further, Samples 1 and 2 showed a lower Dmin and improved image storability compared with Comparative Example 7. Sample 3 according to the present invention showed a lower Dmin compared with Comparative Example 6, and a lower Dmin and improved image storability compared with Comparative Example 7. That is, according to the present invention, good photographic performance as well as good image storability could be obtained.

What is claimed is:

1. An image recording material comprising, on a support, a photosensitive silver halide, a reducing agent, a binder and a compound represented by the following Formula (1):

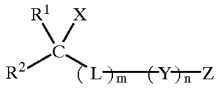

wherein, in Formula (1), $R^1$ and $R^2$ each independently represent a substituent, $R^1$ and $R^2$maybe bonded to each other to form a ring, X represents a halogen atom, L represents a methylene group, m represents an integer of 0–7, Y represents a divalent bridging group, n represents 0 or 1 and Z represents a residue derived from a photographically useful compound.

2. An image record material according to claim 1, wherein $R^1$–C–$R^2$ in Formula (1) has a photographic coupler compound.

3. An image record material according to claim 1, wherein X in Formula (1) is a chlorine atom or a bromine atom.

4. An image record material according to claim 1, wherein L in Formula (1) is a methylene group substituted by a linear, branched or cyclic alkyl group or an alkyl group consisting of a combination thereof, or a methylene group substituted by an aryl group.

5. An image record material according to claim 1, wherein L in Formula (1) is a methylene group substituted by a linear, branched or cyclic alkyl group or an alkyl group consisting of a combination thereof.

6. An image record material according to claim 1, wherein L in Formula (1) is an unsubstituted methylene group.

7. An image record material according to claim 1, wherein m in Formula (1) is an integer of 0–5.

8. An image record material according to claim 1, wherein m in Formula (1) is 0, 1 or 2.

9. An image record material according to claim 1, wherein Y in Formula (1) has a structure represented by

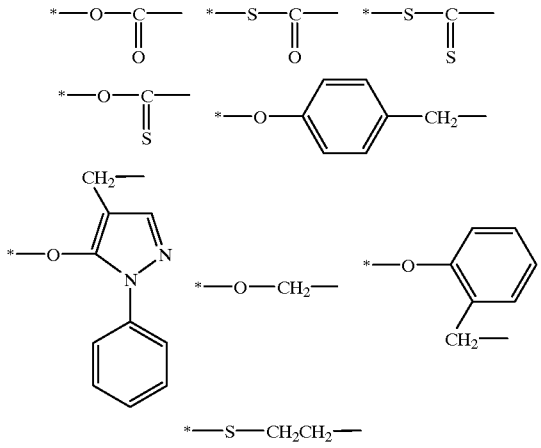

wherein represents a bonding site in L.

10. An image record material according to claim 1, wherein Z in Formula (1) binds to L or Y via a hetero atom constituting Z.

11. An image record material according to claim 1, wherein Z in Formula (1) is a residue derived from an antifoggaint.

12. An image record material according to claim 1, wherein Z in Formula (1) is a residue derived from a development accelerator.

13. An image record material according to claim 1, wherein Z in Formula (1) is a residue derived from a leuco dye.

14. An image record material according to claim 1, wherein the compound represented by Formula (1) is contained in a layer comprising a silver salt or a layer adjacent thereto.

15. An image record material according to claim 1, wherein the compound represented by Formula (1) is contained in an amount of $1\times10^{-6}$ to 1 mole per one mole of silver.

16. An image record material according to claim 1, wherein the compound represented by Formula (1) is contained in an amount of $1\times10^{-5}$ to $5\times10^{-1}$ mole per one mole of silver.

17. An image record material according to claim 1, wherein the compound represented by Formula (1) is contained in an amount of $2\times10^{-5}$ to $2\times10^{-1}$ mole per one mole of silver.

18. An image record material according to claim 1, which further contains a reducible silver salt.

19. An image record material according to claim 1, which further contains an ultrahigh contrast agent.

20. An image record material according to claim 1, which is a thermally processed image recording material.

21. The image recording material of claim 1, wherein $R^1$ and $R^2$ are each independently selected from the group consisting of an alkyl group, an alkenyl group, and alkynyl group, an aryl group, a heterocyclic group, a cyano group, a hydroxyl group, a nitro group, a carboxyl group, an alkoxy group, an aryloxy group, a silyloxy group, a heterocyclyloxy group, an acyloxy group, a carbamoyloxy group, an alkoxycarbonyloxy group, an aryloxycarbonyloxy group, an amino group, an acylamino group, an aminocarbonylamino group, a sulfamoylamino group, an alkyl- or arylsulfonylamino group, a mercapto group, an alkylthio group, an arylthio group, a heterocyclylthio group, a sulfamoyl group, a sulfo group, an alkyl- or arylsulfonyl group, an acyl group, an aryloxycarbonyl group, an alkoxycarbonyl group, a carbamoyl group, an aryl- or heterocyclylazo group, an imido group, a phosphino group, a phosphinyl group, a phosphinyloxy group, a phosphinylamino group, and a silyl group.

* * * * *